US008710942B2

(12) United States Patent
Yoshikawa

(10) Patent No.: US 8,710,942 B2
(45) Date of Patent: Apr. 29, 2014

(54) BANDPASS FILTER AND RADIO COMMUNICATION MODULE AND RADIO COMMUNICATION DEVICE USING THE SAME

(75) Inventor: Hiromichi Yoshikawa, Kirishima (JP)
(73) Assignee: Kyocera Corporation, Kyoto (JP)

( * ) Notice: Subject to any disclaimer, the term of this patent is extended or adjusted under 35 U.S.C. 154(b) by 693 days.
(21) Appl. No.: 12/994,753
(22) PCT Filed: May 28, 2009
(86) PCT No.: PCT/JP2009/059814
§ 371 (c)(1),
(2), (4) Date: Nov. 24, 2010
(87) PCT Pub. No.: WO2009/145276
PCT Pub. Date: Dec. 3, 2009

(65) Prior Publication Data
US 2011/0069739 A1 Mar. 24, 2011

(30) Foreign Application Priority Data
May 28, 2008 (JP) ..... 2008-139328
Jun. 26, 2008 (JP) ..... 2008-167416

(51) Int. Cl.
*H01P 1/203* (2006.01)
*H01P 7/08* (2006.01)

(52) U.S. Cl.
USPC ..... 333/204; 333/219

(58) Field of Classification Search
USPC ..... 333/204, 205, 219, 235, 100, 132, 203, 333/185
See application file for complete search history.

(56) References Cited

U.S. PATENT DOCUMENTS 4,313,097 A * 1/1982 de Ronde ..... 333/204
5,926,466 A 7/1999 Ishida et al.
6,147,571 A 11/2000 Kitazawa et al.
6,177,853 B1 1/2001 Nagatomi et al.
6,359,531 B1 3/2002 Nagatomi et al.
2004/0066256 A1 4/2004 Maekawa et al.
2009/0140827 A1 6/2009 Yoshikawa
2010/0219915 A1 9/2010 Yoshikawa et al.
2010/0253448 A1 10/2010 Yoshikawa

FOREIGN PATENT DOCUMENTS

JP 61-258503 A 11/1986
JP 63257302 A 10/1988
JP 1990-64203 A 11/1991
JP 2000-516060 T 11/2000
JP 200216403 A 7/2003
JP 2004147300 A 5/2004
JP 2004-180032 A 6/2004
JP 2008-118615 A 5/2008
JP 2009-088598 A 4/2009
JP 2008-321738 A 7/2010
JP 2010-209706 A 9/2010
WO WO-2009/028691 A1 3/2009

OTHER PUBLICATIONS

Li, K., et al., "An Ultra-Wideband Bandpass Filter Using Broadside-Coupled Microstrip-Coplanar Waveguide Structure," Proceedings of the Mar. 2005 IEICE General Conference, C-2-114, p. 147.

* cited by examiner

*Primary Examiner* — Benny Lee
*Assistant Examiner* — Gerald Stevens
(74) *Attorney, Agent, or Firm* — Birch, Stewart, Kolasch & Birch, LLP

(57) ABSTRACT

Provided are a bandpass filter and a radio communication module and a radio communication device using the same. The bandpass filter includes: a first and a second grounding electrode arranged on the upper and the lower surface of a layered body; single resonance electrodes and composite resonance electrodes arranged to orthogonally intersect the single resonance electrodes; a first input coupling electrode opposing to the single resonance electrode of the input stage and a second input coupling electrode connected thereto and opposing to the composite resonance electrode of the input stage; a first output coupling electrode opposing to the single resonance electrode of the output stage and a second output coupling electrode connected thereto and opposing to the composite resonance electrode of the output stage.

8 Claims, 23 Drawing Sheets

BANDPASS FILTER AND RADIO COMMUNICATION MODULE AND RADIO COMMUNICATION DEVICE USING THE SAME

This application is the national stage of International Application No. PCT/JP2009/059814 filed on May 28, 2009, which claims priority under 35 USC §119 (a)-(d) of Application No. 2008-139328 filed in Japan on May 28, 2008 and Application No. 2008-167416 filed in Japan on Jun. 26, 2008.

FIELD

The present invention relates to a bandpass filter and a radio communication module and a radio communication device using the same, particularly to a bandpass filter comprising a remarkably wide passband that can suitably be used for UWB (Ultra Wide Band) and a radio communication module and a radio communication device using the same.

BACKGROUND

Recently UWB receives attention as new communication means. In UWB, large-capacity data transfer can be realized within a short range of about 10 m by the use of a wide frequency band.

Recently a study on an ultra-wide-band filter that can be used for UWB is actively made. For example, there has been reported that a wide-band characteristic of a passband width exceeding 100% in terms of fractional band width (band width/center frequency) is obtained with a bandpass filter in which a principle of a directional coupler is applied (for example, see Non-patent Document 1).

On the other hand, a bandpass filter in which a plurality of quarter-wave stripline resonators are provided in parallel while mutually coupled is well known as a filter frequently used conventionally (for example, see Japanese Patent Publication Laid-Open No. 2004-180032).

PRIOR ART REFERENCE

Patent Reference

Patent reference 1: JP2004-180032

Non-Patent Reference

Non-patent reference 1: "Ultra-Wide-Band Bandpass Filter Using Broadside-Coupled Microstrip-Coplanar Waveguide Structure", IEICE Proceedings (March, 2005) C-2-114, p. 147).

SUMMARY OF INVENTION

Problems to be Solved by the Invention

However, the bandpass filters proposed in Non-patent Document 1 and Patent Document 1 had problems respectively, and in particular, were not appropriate for the UWB bandpass filter.

For example, the bandpass filter proposed in Non-patent Document 1 had a problem in that the passband width was too wide. In other words, the UWB basically uses a frequency band ranging from 3.1 GHz to 10.6 GHz, whereas the Radiocommunications Sector of the International Telecommunication Union proposes a standard that demultiplexes into Low Band using a frequency band ranging from approximately 3.1 to 4.7 GHz, and High Band using a frequency band ranging from approximately 6 GHz to 10.6 GHz, thus avoiding the use of 5.3 GHz at IEEE802.11.a. Accordingly, because both a passband width ranging from approximately 40% to 50% of the fractional bandwidth and attenuation at 5.3 GHz are required simultaneously for filters used for Low Band and High Band of UWB, the bandpass filter proposed in Non-patent document 1 comprising a characteristic with a passband width greater than 100% of the fractional bandwidth could not be used due to its wide passband width.

Additionally, the passband width of the bandpass filter using a conventional ¼ wavelength resonator is too narrow, and even the passband width of the bandpass filter described in Patent document 1, which attempted to provide a wider bandwidth, did not meet 10% of the fractional bandwidth. Accordingly, it cannot be used as a bandpass filter for UWB, which requires a wide passband width corresponding to 40% to 50% of the fractional bandwidth.

The present invention has been devised in view of the problems in the prior art, with the objective of providing a bandpass filter, which has two substantially wide passbands and which can obtain an excellent filter characteristics even if it is thinned, as well as a wireless communication module and a wireless communication device using the same.

Means for Solving the Problem

A first aspect of a bandpass filter of the present invention comprises a laminated body, a first ground electrode and a second ground electrode, a plurality of strip-shaped single resonance electrodes, a plurality of complex resonance electrodes, a strip-shaped first input coupling electrode, a strip-shaped first output coupling electrode, a second input coupling electrode, and a second output coupling electrode. The laminated body comprises a plurality of laminated dielectric layers. The first ground electrode is disposed on the bottom surface of the laminated body. The second ground electrode is disposed on the top surface of the laminated body. The plurality of single resonance electrodes are disposed side by side so as to be electromagnetically coupled to each other on a first interlayer of the laminated body, and each one end thereof is grounded to function as a resonator that resonates at a first frequency.

The plurality of complex resonance electrodes comprises a base portion and a plurality of strip-shaped protruding portions. One end of the base portion is grounded, the plurality of protruding portions are disposed side by side so that each one end thereof is connected to the other end of the base portion. One end of the base portion is one end of the complex resonance electrode, and the other end of the protruding portion is the other end of the complex resonance electrode, One end of the complex resonance electrode is grounded, resulting in the entire body combining the base portion with the protruding portions functioning as a resonator that resonates at a second frequency higher than the first frequency, and the protruding portion functioning as a resonator that resonates at a third frequency higher than the second frequency. The plurality of complex resonance electrodes are disposed side by side so as to be electromagnetically coupled to each other on a second interlayer different from the first interlayer of the laminated body.

The first input coupling electrode is disposed on a third interlayer located between the first interlayer and the second interlayer of the laminated body, facing a region over more than half the length, in the longitudinal direction, of a single resonance electrode on the input stage of the plurality of single resonance electrodes and electromagnetically coupled to the region, and has an electrical signal input point into which electrical signals are input.

The first output coupling electrode is disposed on the third interlayer of the laminated body, facing a region over more than half the length, in the longitudinal direction, of a single resonance electrode on the output stage of the plurality of single resonance electrodes and electromagnetically coupled to the region, and has an electrical signal output point from which electrical signals are output.

The second input coupling electrode is disposed on an interlayer located between the first interlayer and the second interlayer of the laminated body, and facing the protruding portion on the input stage of the plurality of protruding portions on the complex resonance electrode on the input stage of the plurality of complex resonance electrodes and electromagnetically coupled to the protruding portion.

The second output coupling electrode is disposed on an interlayer located between the first interlayer and the second interlayer of the laminated body, and facing the protruding portion on the output stage of the plurality of protruding portions on the complex resonance electrode on the output stage of the plurality of complex resonance electrodes and electromagnetically coupled to the protruding portion.

The plurality of single resonance electrodes and the plurality of protruding portions on the plurality of complex resonance electrodes are disposed orthogonally to each other if seen from the direction of lamination of the laminated body. The second input coupling electrode is connected to the side farther from the electrical signal input point relative to the center, in the longitudinal direction, of the portion facing the single resonance electrode on the input stage of the first input coupling electrode so that electrical signals are input via the first input coupling electrode. The second output coupling electrode is connected to the side farther from the electrical signal output point relative to the center, in the longitudinal direction, of the portion facing the single resonance electrode on the output stage of the first output coupling electrode so that electrical signals are output via the first output coupling electrode.

A second aspect of a bandpass filter the present invention comprises a laminated body, a first ground electrode and a second ground electrode, four or more strip-shaped single resonance electrodes, a plurality of complex resonance electrodes, a strip-shaped first input coupling electrode, a strip-shaped first output coupling electrode, a second input coupling electrode, a second output coupling electrode, and a single resonance electrode coupling conductor.

The complex resonance electrodes comprises a base portion and a plurality of strip-shaped protruding portions. One end of the base portion is grounded. The plurality of protruding portions are disposed side by side so that each one end thereof is connected to the other end of the base portion. One end of the base portion is one end of the complex resonance electrode, and the other end of the protruding portion is the other end of the complex resonance electrode. One end of the complex resonance electrode is grounded, resulting in the entire body combining the base portion with the protruding portions functioning as a resonator that resonates at a second frequency higher than the first frequency, and the protruding portion functioning as a resonator that resonates at a third frequency higher than the second frequency. The plurality of complex resonance electrodes are disposed side by side so as to be electromagnetically coupled to each other on a second interlayer different from the first interlayer of the laminated body.

The first input coupling electrode is disposed on a third interlayer located between the first interlayer and the second interlayer of the laminated body, facing a region over more than half the length, in the longitudinal direction, of a single resonance electrode on the input stage of the four or more single resonance electrodes and electromagnetically coupled to the region, and has an electrical signal input point into which electrical signals are input. The first output coupling electrode is disposed on the third interlayer of the laminated body, facing a region over more than half the length, in the longitudinal direction, of a single resonance electrode on the output stage of the four or more single resonance electrodes and electromagnetically coupled to the region, and has an electrical signal output point from which electrical signals are output;

The second input coupling electrode is disposed on an interlayer located between the first interlayer and the second interlayer of the laminated body, and facing the protruding portion on the input stage of the plurality of protruding portions on the complex resonance electrode on the input stage of the plurality of complex resonance electrodes and electromagnetically coupled to the protruding portion. The second output coupling electrode is disposed on an interlayer located between the first interlayer and the second interlayer of the laminated body, and facing the protruding portion on the output stage of the plurality of protruding portions on the complex resonance electrode on the output stage of the plurality of complex resonance electrodes and electromagnetically coupled to the protruding portion;

The single resonance electrode coupling conductor that is disposed on a fourth interlayer located on the opposite side from the third interlayer sandwiching the first interlayer in between. The single resonance electrode coupling conductor comprises one end that is grounded in the vicinity of the one end of the single resonance electrode on a foremost stage comprising a single resonance electrode group comprising an even number, specifically four or more, of adjacent the single resonance electrodes, and the other end that is grounded in the vicinity of the one end of the single resonance electrode on the rearmost stage comprising the single resonance electrode group, and has regions that are each electromagnetically coupled facing the one end of the single resonance electrode on the foremost stage and the single resonance electrode on the rearmost stage.

The single resonance electrode and the protruding portion on the complex resonance electrode are disposed orthogonally to each other if seen from the direction of lamination of the laminated body. The second input coupling electrode is connected to the side farther from the electrical signal input point relative to the center, in the longitudinal direction, of the portion facing the single resonance electrode on the input stage of the first input coupling electrode so that electrical signals are input via the first input coupling electrode. The second output coupling electrode is connected to the side farther from the electrical signal output point relative to the center, in the longitudinal direction, of the portion facing the single resonance electrode on the output stage of the first output coupling electrode so that electrical signals are output via the first output coupling electrode.

A third aspect of a wireless communication module of the present invention comprises the first or the second aspect of the bandpass filter.

A fourth aspect of a wireless communication device of the present invention comprises an RF portion including the first or the second aspect of the bandpass filter, a baseband portion connected to the RF portion, and an antenna connected to the RF portion.

The electrical signal input point of the first input coupling electrode is the point into which electrical signals are input for the first input coupling electrode, and the electrical signal output point of the first output coupling electrode is the point into which electrical signals are output from the first output coupling electrode. The side farther from the electrical signal input point relative to the center, in the longitudinal direction, of the portion facing the single resonance electrode on the input stage of the first input coupling electrode is the side of the region not comprising the electrical signal input point obtained by dividing the first input coupling electrode into two regions in accordance with the boundary that is the center, in the longitudinal direction, of the portion facing the single resonance electrode on the input stage. Likewise, the side farther from the electrical signal output point relative to the center, in the longitudinal direction, of the portion facing the single resonance electrode on the output stage of the first output coupling electrode is the side of the region not comprising the electrical signal output point obtained by dividing the first output coupling electrode into two regions in accordance with the boundary that is the center, in the longitudinal direction, of the portion facing the single resonance electrode on the output stage.

Advantageous Effect of the Invention

According to the bandpass filter of the first and the second aspects of the present invention, because a plurality of single resonance electrodes and a plurality of protruding portions on a plurality of complex resonance electrodes are orthogonally disposed to each other when seen from the direction of lamination of the laminated body, the electromagnetic coupling generated between the plurality of single resonance electrodes and the plurality of protruding portions on the plurality of complex electrodes can be minimized even when the laminated body is thin and the plurality of single resonance electrodes are in the close vicinity of the plurality of complex resonance electrodes; hence, deterioration of the bandpass characteristics in the passband due to stronger electromagnetic coupling between the plurality of single resonance electrodes and the plurality of complex resonance electrodes can be prevented.

Additionally, according to the bandpass filter of the first and the second aspects of the present invention, the first input coupling electrode is electromagnetically coupled facing a region over more than half the length, in the longitudinal direction, of the single resonance electrode on the input stage via a dielectric layer, the first output coupling electrode is electromagnetically coupled facing a region over more than half the length, in the longitudinal direction, of the single resonance electrode on the output stage via the dielectric layer, the second input coupling electrode is connected to the side farther from the electrical signal input point relative to the center, in the longitudinal direction, of the portion facing the single resonance electrode on the input stage of the first input coupling electrode so that electrical signals are input via the first input coupling electrode, and the second output coupling electrode is connected to the side farther from the electrical signal output point relative to the center, in the longitudinal direction, of the portion facing the single resonance electrode on the output stage of the first output coupling electrode so that electrical signals are output via the first output coupling electrode. In this way, the electromagnetic coupling of the first input coupling electrode with the single resonance electrode on the input stage and the electromagnetic coupling of the first output coupling electrode with the single resonance electrode on the output stage can be sufficiently strengthened; hence, a bandpass filter comprising excellent flat and low-loss bandpass characteristics can be obtained across the entire wide passband formed by a plurality of single resonance electrodes.

According to the wireless communication module of the third aspect of the present invention and the wireless communication device of the fourth aspect of the present invention, by using the bandpass filter of the first aspect of the present invention with small signal loss across the entire communication band for filtering waves of transmitted signals and received signals, attenuation of transmitted signals and received signals that pass the bandpass filter is reduced, resulting in increased reception sensitivity, in addition, the amplification degree of transmitted signals and received signals can be small, resulting in less power consumption in the amplifier circuit. Therefore, an enhanced wireless communication module and a wireless communication device with high receiving sensitivity and low power consumption can be obtained. Furthermore, by using the bandpass filter of the first aspect of the present invention, in which two communication bands can be covered by one filter and excellent filter characteristics can be obtained even if it is thinned, a wireless communication module and a wireless communication device with small size and low manufacturing cost can be obtained.

BRIEF DESCRIPTION OF THE DRAWINGS

The objectives, features, and advantages of the present invention shall become apparent from the following detailed description and the figures.

MODE FOR CARRYING OUT THE INVENTION

Hereinafter, a bandpass filter as well as a wireless communication module and a wireless communication device using the same according to the preferred embodiments of the present invention are described in detail with reference to the figures attached.

First Embodiment

Figure 1:
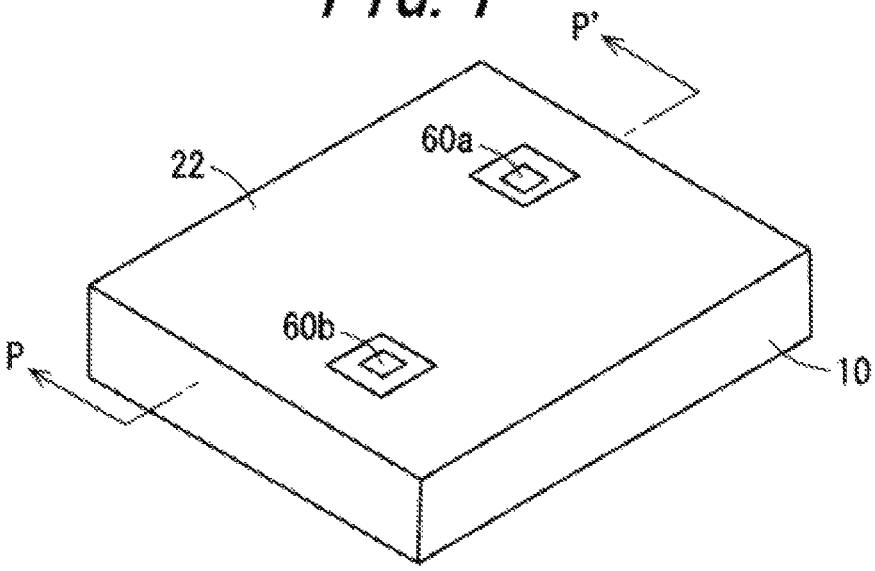
FIG. 1 is an external perspective view schematically showing the bandpass filter according to the first embodiment of the present invention.
Figure 2:
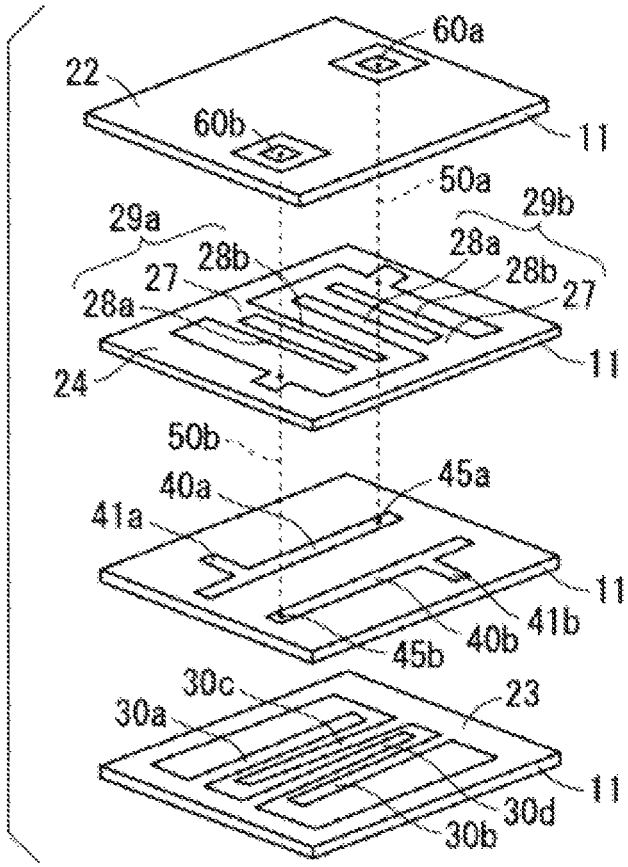
FIG. 2 is a schematic exploded perspective view of the bandpass filter shown in FIG. 1.
Figure 3:
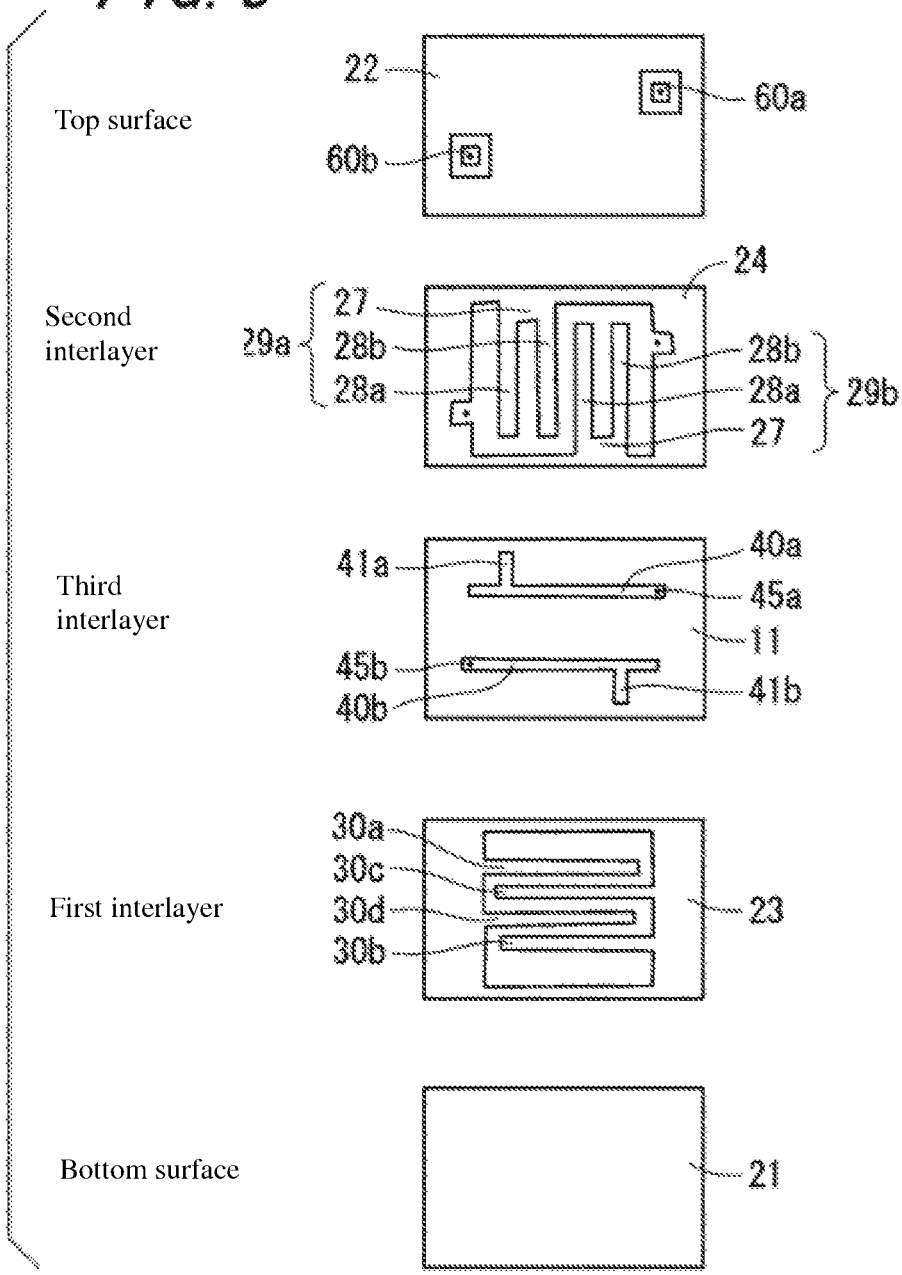
FIG. 3 is a plain view schematically showing the top and bottom surfaces and interlayer of the bandpass filter shown in FIG. 1.
Figure 4:
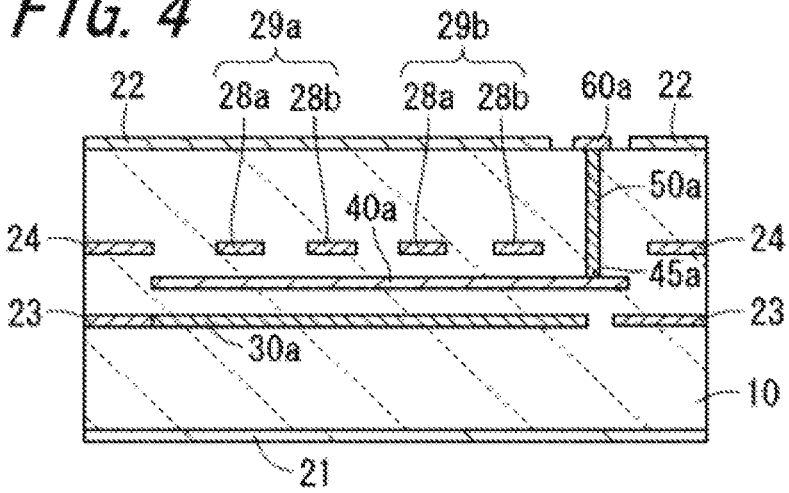
FIG. 4 is a cross-sectional view taken from the line P-P' shown in FIG. 1.

FIG. 1 is an external perspective view schematically showing the bandpass filter according to the first embodiment of the present invention. FIG. 2 is a schematic exploded perspective view of the bandpass filter shown in FIG. 1. FIG. 3 is a plain view schematically showing the top and bottom surfaces and interlayer of the bandpass filter shown in FIG. 1. FIG. 4 is a cross-sectional view taken from the line P-P' shown in FIG. 1.

The bandpass filter of this embodiment comprises a laminated body 10, a first ground electrode 21, a second ground electrode 22, strip-shaped single resonance electrodes 30*a*, 30*b*, 30*c*, 30*d*, and complex resonance electrodes 29*a*, 29*b*, as shown in FIG. 1 to FIG. 4. A laminated body 10 comprises a plurality of dielectric laminated layers 11. The first ground electrode 21 is disposed on the bottom surface of the laminated body 10. The second ground electrode 22 is disposed on the top surface of the laminated body 10. The single resonance electrodes 30*a*, 30*b*, 30*c*, 30*d* are disposed side by side so as to alternate one end and the other end on a first interlayer of the laminated body 10, and each one end thereof is grounded to function as a resonator that resonates at a first frequency, and are electromagnetically coupled to each other. The complex resonance electrodes 29*a*, 29*b* are disposed side by side on a second interlayer of the laminated body 10 so as to be electromagnetically coupled to each other. Additionally, the complex resonance electrodes 29*a*, 29*b* comprises a base portion 27 and strip-shaped protruding potions 28*a*, 28*b*. One end of the base portion 27 is grounded. The protruding portions 28*a*, 28*b* are disposed side by side so that each one end is connected to the other end of the base portion 27. One end of the base portion 27 is one end of the complex resonance electrodes 29*a*, 29*b*, and the other end of the protruding portions 28*a*, 28*b* is the other end of the complex resonance electrodes 29*a*, 29*b*. One end of the complex resonance electrodes 29*a*, 29*b* are grounded, resulting in the entire body combining the base portion 27 with the protruding portions 28*a*, 28*b* functioning as a resonator that resonates at a second frequency higher than the first frequency, and the protruding portions 28*a*, 28*b* functioning as a resonator that resonates at a third frequency higher than the second frequency.

Additionally, the bandpass filter of this embodiment comprises a strip-shaped first input coupling electrode 40*a*, a strip-shaped first output coupling electrode 40*b*, a second input coupling electrode 41*a*, and a second output coupling electrode 41*b*. The first input coupling electrode 40*a* is disposed on a third interlayer located between the first interlayer and the second interlayer of the laminated body 10, faces a region over more than half the length, in the longitudinal direction, of the single resonance electrode on the input stage 30*a* and electromagnetically coupled to the region, and has an electrical signal input point 45*a* into which electrical signals are input. The first output coupling electrode 40*b* is face a region over more than half the length, in the longitudinal direction, of the single resonance electrode on an output stage 30*b* and electromagnetically coupled to the region, and has an electrical signal output point 45*b* from which electrical signals are output. The second input coupling electrode 41*a* facing the protruding portion on the input stage 28*a* of the complex resonance electrode on the input stage 29*a* and is electromagnetically coupled to the region. The second output coupling electrode 41*b* faces the protruding portion 28*b* on the output stage of the complex resonance electrode on the output stage 29*b* and is electromagnetically coupled to the protruding portion 28*b*. The first input coupling electrode 40*a* is integrated with the second input coupling electrode 41*a*, and the first output coupling electrode 40*b* is integrated with the second output coupling electrode 41*b*.

Furthermore, the bandpass filter of this embodiment comprises a first annular ground electrode 23 and a second annular ground electrode 24. The first annular ground electrode 23 is annularly formed on the first interlayer of the laminated body 10 so as to surround the circumference of the single resonance electrodes 30*a*, 30*b*, 30*c*, 30*d*, is connected to each one end of the single resonance electrodes 30*a*, 30*b*, 30*c*, 30*d*, and is connected to the ground potential. The second annular ground electrode 24 is annularly formed on the second interlayer so as to surround the circumference of the complex resonance electrodes 29*a*, 29*b*, is connected to the one end of the complex resonance electrodes 29*a*, 29*b*, and is connected to the ground potential.

Furthermore, in the bandpass filter of this embodiment, the first input coupling electrode 40*a* is connected to an input terminal electrode 60*a* disposed on the top surface of the laminated body 10 via a through-conductor 50*a* that penetrates a dielectric layer 11, and the first output coupling electrode 40*b* is connected to an output terminal electrode 60*b* disposed on the top surface of the laminated body 10 via a through-conductor 50*b* that penetrates the dielectric layer 11. Accordingly, the connection point between the first input coupling electrode 40*a* and the through-conductor 50*a* is an electrical signal input point 45*a* in the first input coupling electrode 40*a*, and the connection point between the first output coupling electrode 40*b* and the through-conductor 50*b* is an electrical signal output point 45*b* in the first output coupling electrode 40*b*.

In the bandpass filter of this embodiment comprising such a configuration, if electrical signals are input from an external circuit into the first input coupling electrode 40*a* via the input terminal electrode 60*a* and the through-conductor 50*a*, the single resonance electrode on the input stage 30*a* electromagnetically coupled to the first input coupling electrode 40*a* becomes excited, the single resonance electrodes 30*a*, 30*b*, 30*c*, 30*d* electromagnetically coupled to each other resonate, and electrical signals are thus output to the external circuit from the first output coupling electrode 40*b* electromagnetically coupled to the single resonance electrode on the output stage 30*b* via the through-conductor 50*b* and the output terminal electrode 60*b*. At this time, signals of a first frequency band, including the first frequency where the single resonance electrodes 30*a*, 30*b*, 30*c*, 30*d* resonate, selectively pass through; hence, the first passband is thereby formed. At the same time, electrical signals are also input from an external circuit into the second input coupling electrode 41*a* via the input terminal electrode 60*a*, the through-conductor 50*a*, and the first input coupling electrode 40*a*; hence, if the complex resonance electrode 29*a* on the input stage electromagnetically coupled to the second input coupling electrode 41*a* becomes excited, the complex resonance electrodes 29*a*, 29*b* electromagnetically coupled to each other resonate, and electrical signals are thus output to the external circuit from the second output coupling electrode 41*b* electromagnetically coupled to the complex resonance electrode 29*b* on the output stage via the first output electrode 40*b*, the through-conductor 50*b*, and the output terminal electrode 60*b*. At this time, signals of a second frequency band, including the second frequency and the third frequency where the complex resonance electrodes 29*a*, 29*b* resonate, selectively pass through, and the second passband is thereby formed. In this way, the bandpass filter of this embodiment functions as a bandpass filter comprising two passbands with different frequencies.

In the bandpass filter of this embodiment, the electric length of the strip-shaped single resonance electrodes 30*a*, 30*b*, 30*c*, 30*d* is set to be approximately ¼ of the wavelength at the first frequency, and one end thereof is respectively connected to the first annular ground electrode 23, resulting in their functioning as a ¼ wavelength resonator. Additionally, the complex resonance electrodes 29*a*, 29*b* comprise the base portion 27 and a plurality of strip-shaped protruding portions 28*a*, 28*b*, one end of the base portion 27 is grounded, a plurality of protruding portions 28*a*, 28*b* are disposed side by side with an interval so that each one end is connected to the other end of the base portion 27, one end of the base portion 27 is one end of the complex resonance electrodes 29*a*, 29*b*, and the other end of the protruding portions 28*a*, 28*b* are the other end of the complex resonance electrodes 29*a*, 29*b*.

Additionally, one end of the complex resonance electrodes 29*a*, 29*b* (i.e., one end of the base portion 27) are grounded, resulting in their functioning basically as a ¼ wavelength resonator in which the entire body combining the base portion 27 with the protruding portions 28*a*, 28*b* resonates at the second frequency, and in addition functioning as a ¼ wavelength resonator in which the protruding portions 28*a*, 28*b* resonate at the third frequency, which is higher than the second frequency.

Accordingly, the length of the entire complex resonance electrode combining the base portion 27 with the protruding portions 28*a*, 28*b* is approximately equivalent to ¼ the wavelength at the second frequency, and the length of the protruding portions 28*a*, 28*b* is approximately equivalent to ¼ the wavelength at the third frequency. The length of the protruding portion 28*a* and the protruding portion 28*b* is basically set to be equivalent; however, there may be cases in which the length varies depending on the coupled state with another electrodes, etc. Additionally, although the number of the protruding portions may be 3 or more, for minimizing the size, 2 is better.

Additionally, in the bandpass filter of this embodiment, the single resonance electrodes 30*a*, 30*b*, 30*c*, 30*d* are disposed side by side on the first interlayer of the laminated body 10 so as to alternate each one end and electromagnetically coupled in an inter-digital form, and the complex resonance electrodes 29*a*, 29*b* are disposed side by side on the second interlayer of the laminated body 10 so as to alternate each one end and electromagnetically coupled in an inter-digital form. Accordingly, with a strong coupling of the inter-digital form in which coupling via the magnetic field and coupling via the electric field are added, it is possible to make the interval between the resonance frequencies of each resonant mode forming the passband an appropriate one for obtaining a substantially wide passband width exceeding 10% of the fractional bandwidth. Stronger coupling can be obtained with smaller intervals between each of resonance electrodes that are disposed side by side; however, this causes difficulty in manufacturing if the intervals are smaller; therefore, it is set to be, for example, approximately 0.05 to 0.5 mm.

Furthermore, in the bandpass filter of this embodiment, a dimension of the first input coupling electrode 40*a* and the first output coupling electrode 40*b* is preferably set to be approximately the same as that of the single resonance electrode on the input stage 30*a* and the single resonance electrode on the output stage 30*b*. Additionally, stronger coupling can be obtained with smaller intervals between the first input coupling electrode 40*a* and the first output coupling electrode 40*b*, and the single resonance electrode on the input stage 30*a* and the single resonance electrode on the output stage 30*b* as well as between the second input coupling electrode 41*a* and the second output coupling electrode 41*b*, and the complex resonance electrode on the input stage 29*a* and the complex resonance electrode on the output stage 29*b*; however, this causes difficulty in manufacturing; therefore, it is set to be, for example, approximately 0.01 to 0.5 mm.

Furthermore, in the bandpass filter of this embodiment, the second input coupling electrode 41*a* has a strip-shaped shape, is disposed so as to face along the protruding portion 28*a* on the input stage of the complex resonance electrode 29*a* on the input stage, and is integrated with the first input coupling electrode 40*a* so as to intersect with the first input coupling electrode 40*a*. Therefore, the part, in which the first input coupling electrode 40*a* and the second input coupling electrode 41*a* intersect, functions as the first input coupling electrode 40*a*, and also functions as the second input coupling electrode 41*a*. Additionally, the second output coupling electrode 41*b* has a strip-shaped shape, is disposed so as to face along the protruding portion 28*b* on the output stage of the complex resonance electrode 29*b* on the output stage, and is integrated with the first output coupling electrode 40*b* so as to intersect with the first output coupling electrode 40*b*. Therefore, the part, in which the first output coupling electrode 40*b* and the second output coupling electrode 41*b* intersect, functions as the first output coupling electrode 40*b*, and also functions as the second output coupling electrode 41*b*. The lengths of the second input coupling electrode 41*a* and the second output coupling electrode 41*b* are appropriately set depending on a required coupling amount.

According the bandpass filter of this embodiment, because the single resonance electrodes 30*a*, 30*b*, 30*c*, 30*d* and the protruding portions 28*a*, 28*b* on the complex resonance electrodes 29*a*, 29*b* are disposed orthogonally to each other if seen from the direction of lamination of the laminated body 10, the electromagnetic coupling generated between the single resonance electrodes 30*a*, 30*b*, 30*c*, 30*d* and the protruding portions 28*a*, 28*b* on the complex resonance electrode 29*a*, 29*b* can be minimized, even if the thickness of the laminated body 10 is thinner and the single resonance electrodes 30*a*, 30*b*, 30*c*, 30*d* are in the close vicinity of the complex resonance electrodes 29*a*, 29*b*, hence, deterioration of the bandpass characteristics in the passband can be prevented as electromagnetic coupling between the single resonance electrodes 30*a*, 30*b*, 30*c*, 30*d* and the complex resonance electrodes 29*a*, 29*b* becomes too strong.

Additionally, according to the bandpass filter of this embodiment, the first input coupling electrode 40*a* faces a region over more than half the length, in the longitudinal direction, of the single resonance electrode 30*a* on the input stage via the dielectric layer 11 and is electromagnetically coupled to the region. The first output coupling electrode 40*b* faces a region over more than half the length, in the longitudinal direction, of the single resonance electrode 30*b* on the output stage via the dielectric layer 11 and is electromagnetically coupled to the region. In addition, the second input coupling electrode 41*a* is connected to the side farther from the electrical signal input point 45*a* rather than the center, in the longitudinal direction, of the portion facing the single resonance electrode 30*a* on the input stage of the first input coupling electrode 40*a* so that electrical signals are input via the first input coupling electrode 40*a*. The second output coupling electrode 41*b* is connected to the side farther from the electrical signal output point 45*b* rather than the center, in the longitudinal direction, of the portion facing the single resonance electrode 30*b* on the output stage of the first output coupling electrode 40*b* so that electrical signals are output via the first output coupling electrode 40*b*. In this way, the electromagnetic coupling of the first coupling electrode 40*a* with the single resonance electrode 30*a* on the input stage and the electromagnetic coupling of the first output coupling electrode 40*b* with the single resonance electrode 30*b* on the output stage can be sufficiently strengthened; hence, a bandpass filter comprising excellent flat and low-loss bandpass characteristics can be obtained across the entire wide passband formed by the single resonance electrodes 30*a*, 30*b*, 30*c*, 30*d*. This effect is described below.

To obtain excellent flat and low-loss bandpass characteristics across the entire very wide passband exceeding 10% of the fractional bandwidth, it is necessary to make the electromagnetic coupling of the resonance electrode on the input stage with the input coupling electrode and the electromagnetic coupling of the resonance electrode on the output stage with the output coupling electrode substantially strong. However, the inventor of the present application discovered in the studies that excellent bandpass characteristics cannot be obtained in the passband formed by a plurality of single resonance electrodes 30*a*, 30*b*, 30*c*, 30*d*, because only a simple connection of the first input coupling electrode 40*a* facing the single resonance electrode 30*a* on the input stage and electromagnetically coupled to the single resonance electrode 30*a* to the second input coupling electrode 41*a* facing the protruding portion 28*a* on the input stage of the complex resonance electrode 29*a* on the input stage and electromagnetically coupled to the protruding portion 28*a*, and a connection of the first output coupling electrode 40*b* facing the single resonance electrode 30*b* on the output stage and electromagnetically coupled to the single resonance electrode 30*b* to the second output coupling electrode 41*b* facing the protruding portion 28*b* on the output stage of the complex resonance electrode 29*b* on the output stage and electromagnetically coupled to the protruding portion 28*b*, cause insufficient electromagnetic coupling of the first resonance electrode 30*a* on the input stage with the first input coupling electrode 40*a* and insufficient electromagnetic coupling of the single resonance electrode 30*b* on the output stage with the output coupling electrode 40*b*.

Therefore, after performing various studies, the inventor discovered that the electromagnetic coupling of the first input coupling electrode 40*a* with the single resonance electrode 30*a* on the input stage can be sufficiently strong by providing the electrical signal input point 45*a* into which electrical signals are input to the first input coupling electrode 40*a*, connecting the second input coupling electrode 41*a* to the input coupling electrode 40*a* so that the electrical signals are input via the input coupling electrode 40*a*, as well as providing a location at which the second input coupling electrode 41*a* is connected to the first input coupling electrode 40*a* to the side farther from the electrical signal input point 45*a* rather than the center, in the longitudinal direction, of the portion facing the single resonance electrode 30*a* on the input stage of the first input coupling electrode 40*a*. The reason for obtaining such effects is considered that current flowing along the portion facing the single resonance electrode 30*a* on the input stage of the first input coupling electrode 40*a* can be sufficiently ensured by connecting the second input coupling electrode 41*a* to the side farther from the electrical signal input point 45*a* rather than the center, in the longitudinal direction, of the portion facing the single resonance electrode 30*a* on the input stage of the first input coupling electrode 40*a* so that electrical signals are input via the first input coupling electrode 40*a*.

Similarly, the electromagnetic coupling of the first output coupling electrode 40*b* with the single resonance electrode 30*b* on the output stage can be sufficiently strong by providing the electrical signal output point 45*b* from which electrical signals are output to the first output coupling electrode 40*b*, connecting the second output coupling electrode 41*b* to the output coupling electrode 40*b* so that the electrical signals are output via the output coupling electrode 40*b*, and connecting the second output coupling electrode 41*b* to the side farther from the electrical signal output point 45*b* rather than the center, in the longitudinal direction, of the portion facing the single resonance electrode 30*b* on the output stage of the first output coupling electrode 40*b*.

Furthermore, according to the bandpass filter of this embodiment, the electromagnetic coupling of the first input coupling electrode 40*a* to the single resonance electrode 30*a* on the input stage and the electromagnetic coupling of the first output coupling electrode 40*b* to the single resonance electrode 30*b* on the output stage can be further strong because the electrical signal input point 45*a* is located at an end portion, in the longitudinal direction, facing the single resonance electrode 30*a* on the input stage of the first input coupling electrode 40*a*, and the electrical signal output point 45*b* is located at an end portion, in the longitudinal direction, facing the single resonance electrode 30*b* on the input stage of the first output coupling electrode 40*b*.

Furthermore, according to the bandpass filter of this embodiment, the electrical signal input point 45*a* is located at the side farther from the one end (ground end) of the single resonance electrode 30*a* on the input stage rather than the center, in the longitudinal direction, of the portion facing the single resonance electrode 30*a* on the input stage of the first input coupling electrode 40*a*, and the electrical signal output point 45*b* is located at the side farther from the one end (ground end) of the single resonance electrode 30*b* on the output stage rather than the center, in the longitudinal direction, of the portion facing the single resonance electrode on the output stage 30*b* of the first output coupling electrode 40*b*.

In this way, the first input coupling electrode 40*a* is electromagnetically coupled to the single resonance electrode 30*a* on the input stage in an inter-digital form, and the first output coupling electrode 40*b* is electromagnetically coupled to the single resonance electrode 30*b* on the output stage in an inter-digital form; hence, the electromagnetic coupling of the first input coupling electrode 40*a* to the single resonance electrode 30*a* on the input stage and the electromagnetic coupling of the first output coupling electrode 40*b* with the single resonance electrode 30*b* on the output stage can be further strengthened.

Furthermore, according to the bandpass filter of this embodiment, the second input coupling electrode 41*a* is disposed so as to face the one end (ground end) side rather than the center, in the longitudinal direction, of the single resonance electrode 30*a* on the input stage and the second output coupling electrode 41*b* is disposed so as to face the one end (ground end) side rather than the center, in the longitudinal direction, of the single resonance electrode 30*b* on the output stage. In this way, the electrical coupling between the second input coupling electrode 41*a* and the single resonance electrode 30*a* on the input stage can be reduced, and the electrical coupling between the second output coupling electrode 41*b* and the single resonance electrode 30*b* on the output stage can be reduced; hence, deterioration of the filter characteristics due to increased unnecessary electromagnetic coupling between the second input coupling electrode 41*a* and the single resonance electrode 30*a* on the input stage and between the second output coupling electrode 41*b* and the single resonance electrode on the output stage 30*b* can be prevented.

Furthermore, according to the bandpass filter of this embodiment, the second input coupling electrode 41*a* is disposed on the third interlayer such that it is integrated with the first input coupling electrode 40*a*, and the second output coupling electrode 41*b* is disposed on the third interlayer such that it is integrated with the first output coupling electrode 40*b*. Accordingly, a connecting conductor for connecting the first input coupling electrode 40*a* to the second input coupling electrode 41*a* and a connecting conductor for connecting the first output coupling electrode 40*b* to the second output coupling electrode 41*b* are not necessary; hence, a thin bandpass filter, which can eliminate the loss caused by the connecting conductors and comprises a simple structure, can be obtained.

Furthermore, according to the bandpass filter of this embodiment, one end of the single resonance electrode on the input stage and one end of the single resonance electrode 30*b* on the output stage are disposed alternately, and one end of the protruding portion 28*a* on the input stage of the complex resonance electrode 29*a* on the input stage and one end of the protruding portion 28*b* on the output stage of the complex resonance electrode 29*b* on the output stage are disposed alternately. Accordingly, a bandpass filter, in which the electromagnetic coupling of the first input coupling electrode 40*a* to the single resonance electrode 30*a* on the input stage and the first output coupling electrode 40*b* to the single resonance electrode 30*b* on the output stage are sufficiently strong and comprises symmetrical structure and circuit configuration can be obtained.

Furthermore, according to the bandpass filter of this embodiment, because the second passband is formed by using the complex resonance electrodes 29*a*, 29*b*, the second frequency and the third frequency are determined depending on the length of the complex resonance electrodes 29*a*, 29*b* and the length of the protruding portions 28*a*, 28*b*; therefore, a bandpass filter that can easily set the bandwidth of the second passband with a high degree of freedom, can be obtained.

Second Embodiment

Figure 5:
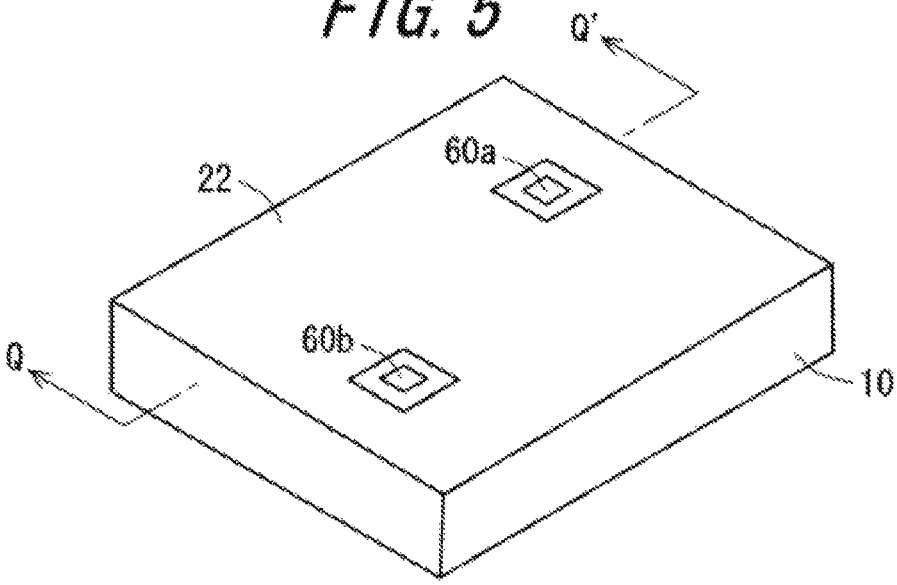
FIG. 5 is an external perspective view schematically showing the bandpass filter according to the second embodiment of the present invention.
Figure 6:
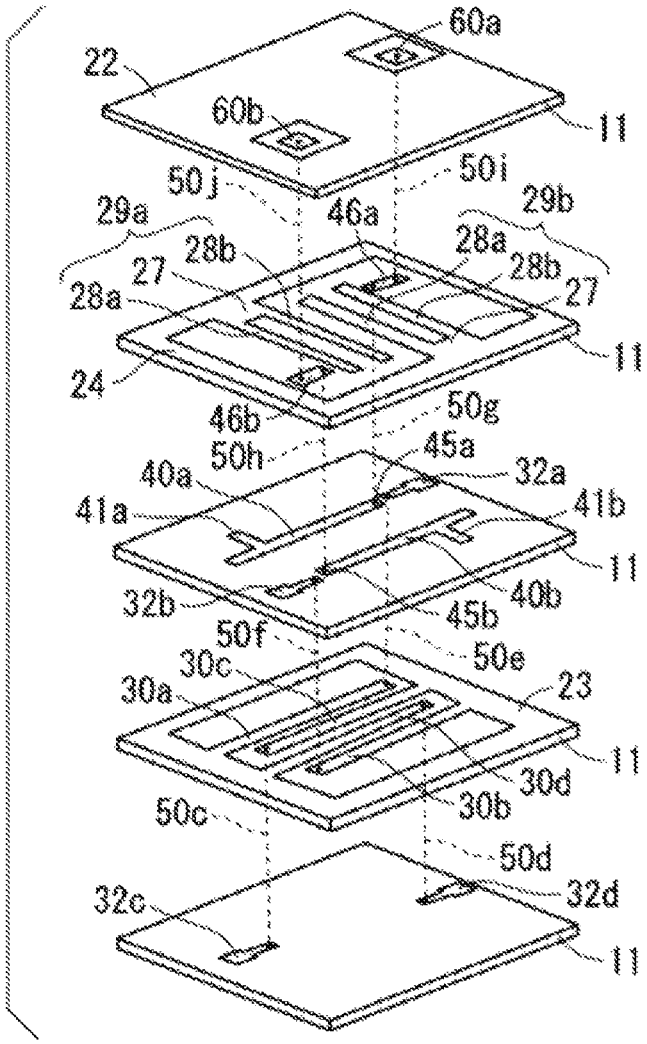
FIG. 6 is a schematic exploded perspective view of the bandpass filter shown in FIG. 5.
Figure 7:
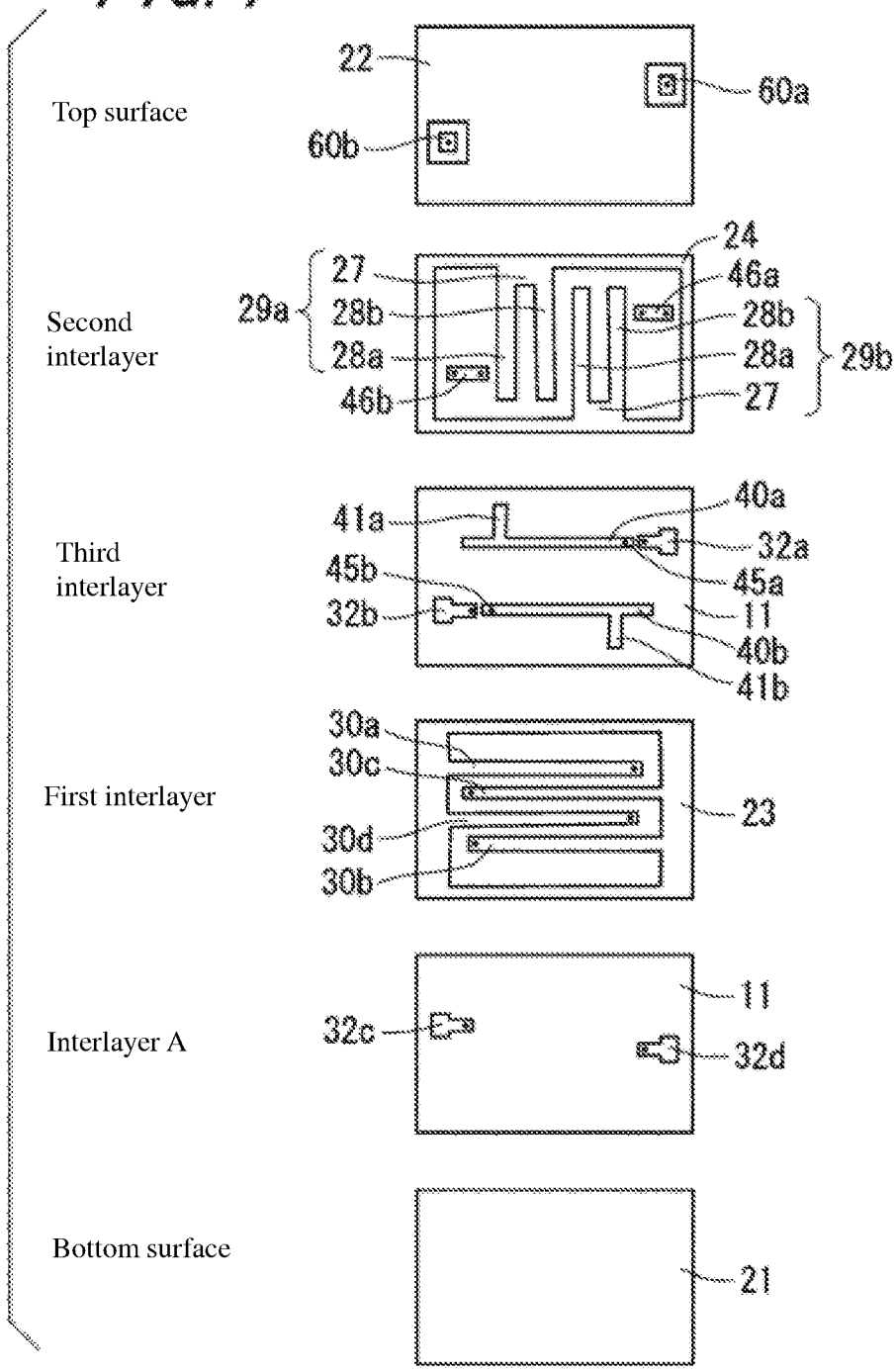
FIG. 7 is a plain view schematically showing the top and bottom surfaces and interlayer of the bandpass filter shown in FIG. 5.
Figure 8:
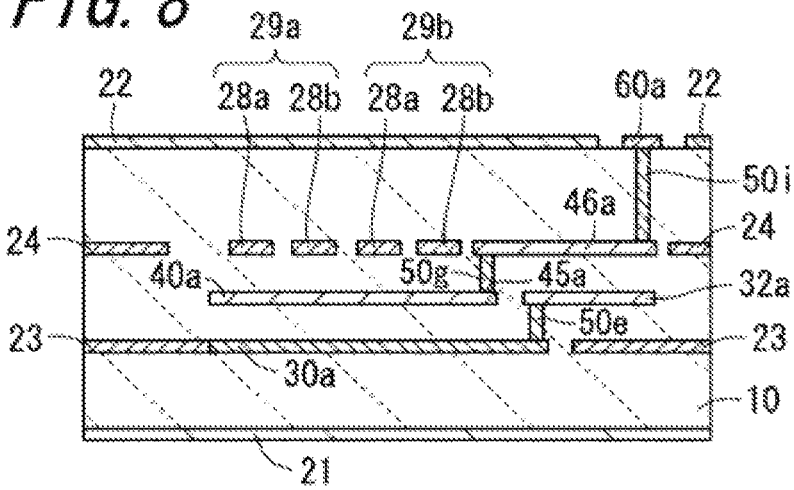
FIG. 8 is a cross-sectional view taken from the line Q-Q' shown in FIG. 5.

FIG. 5 is an external perspective view schematically showing the bandpass filter according to the second embodiment of the present invention. FIG. 6 is a schematic exploded perspective view of the bandpass filter shown in FIG. 5. FIG. 7 is a plain view schematically showing the top and bottom surfaces and interlayer of the bandpass filter shown in FIG. 5. FIG. 8 is a cross-sectional view taken from the line Q-Q' shown in FIG. 5. In addition, in this embodiment, only aspects different from the abovementioned first embodiment will be explained so as to omit redundant explanations, and the same reference characters are used for similar components.

In the bandpass filter of this embodiment, as shown in FIG. 5 to FIG. 8, resonance auxiliary electrodes 32*c*, 32*d* are disposed on an interlayer A located between the lower surface and the first interlayer of the laminated body 10 corresponding to each of the single resonance electrodes 30*c*, 30*d*, which are disposed so as to have a region facing the first annular ground electrode 23 and a region facing the single resonance electrodes 30*c*, 30*d*, and are each connected to the other end side of the single resonance electrodes 30*c*, 30*d* in the region facing the single resonance electrodes 30*c*, 30*d* via through-conductors 50*c*, 50*d* which penetrates the dielectric layer 11. Similarly, resonance auxiliary electrodes 32*a*, 32*b* are disposed on the third interlayer of the laminated body 10 corresponding to each of the single resonance electrodes 30*a*, 30*b*, which are disposed so as to have a region facing the first annular ground electrode 23 and a region facing the single resonance electrodes 30*a*, 30*b*, and are each connected to the other end side of the single resonance electrodes 30*a*, 30*b* in the region facing the single resonance electrodes 30*a*, 30*b* via through-conductors 50*e*, 50*f* which penetrates the dielectric layer 11.

Furthermore, in the bandpass filter of this embodiment, an input coupling auxiliary electrode 46*a* is provided on the second interlayer of the laminated body 10, which is disposed so as to have a region facing the resonance auxiliary electrode 32*a* and a region facing the first input coupling electrode 40*a*, and in which the region facing the first input coupling electrode 40*a* is connected to the first input coupling electrode 40*a* via a through-conductor 50*g*, and the region facing the resonance auxiliary electrode 32*a* is connected to an input terminal electrode 60*a* via a through-conductor 50*i*. Similarly, an output coupling auxiliary electrode 46*b* is provided on an interlayer C, which is disposed so as to have a region facing the resonance auxiliary electrode 32*b* and a region facing the first output coupling electrode 40*b*, and in which the region facing the first output coupling electrode 40*b* is connected to the first output coupling electrode 40*a* via a through-conductor 50*h*, and the region facing the resonance auxiliary electrode 32*b* is connected to an output terminal electrode 60*b* via a through-conductor 50*j*.

According to the bandpass filter of this embodiment comprising such a structure, because the capacitance generated between the resonance auxiliary electrodes 32*a*, 32*b*, 32*c*, 32*d* and the first annular ground electrode 23 is added to the capacitance generated between the single resonance electrodes 30*a*, 30*b*, 30*c*, 30*d* and the ground potential, the lengths of the single resonance electrodes 30*a*, 30*b*, 30*c*, 30*d* can be shortened; therefore, a bandpass filter with a smaller size can be obtained.

Additionally, according to the bandpass filter of this embodiment, the electromagnetic coupling of the input coupling auxiliary electrode 46*a* to the resonance auxiliary electrode 32*a* is added to the electromagnetic coupling of the first input coupling electrode 40*a* to the single resonance electrode 30*a* on the input stage, and the electromagnetic coupling of the output coupling auxiliary electrode 46*b* to the resonance auxiliary electrode 32*b* is added to the electromagnetic coupling of the first output coupling electrode 40*b* to the single resonance electrode on the output stage 30*b*. Therefore, the electromagnetic coupling of the first coupling electrode 40*a* to the single resonance electrode 30*a* on the input stage and the electromagnetic coupling of the first output coupling electrode 40*b* to the single resonance electrode on the output stage 30*b* are further strengthened; hence, even more flat and even more low-loss bandpass characteristics, in which increase of insertion loss at frequencies located between the resonance frequencies in each of the resonance modes is further reduced, can be obtained across the entire wide passband in the passband formed by the single resonance electrodes 30*a*, 30*b*, 30*c*, 30*d* even if the passband is very wide.

However, the area of the portion facing the resonance auxiliary electrodes 32*a*, 32*b*, 32*c*, 32*d* and the first annular ground electrode 23 is set to be approximately 0.01 to 3 $mm^2$, for example, depending on a required capacitance. Greater capacitance can be generated if the interval between the resonance auxiliary electrodes 32*a*, 32*b*, 32*c*, 32*d* and the first annular ground electrode 23 is smaller; however, this causes difficulty in manufacturing; therefore, the interval is set to be approximately 0.01 to 0.5 mm, for example.

Additionally, the widths of the input coupling auxiliary electrode 46*a* and the output coupling auxiliary electrode 46*b* are set to be approximately the same as those of the first input coupling electrode 40*a* and the first output coupling electrode 40*b*, for example, and the lengths of the input coupling auxiliary electrode 46*a* and the output coupling auxiliary electrode 46*b* are set to be slightly longer than the lengths of the resonance auxiliary electrodes 32*a*, 32*b*, for example. Shorter intervals between the input coupling auxiliary electrode 46*a* and the output coupling auxiliary electrode 46*b* and between the resonance auxiliary electrodes 32*a*, 32*b* are preferable in view of generating stronger coupling; however, this causes difficulty in manufacturing; therefore, the intervals are set to be approximately 0.01 to 0.5 mm, for example.

Third Embodiment

Figure 9:
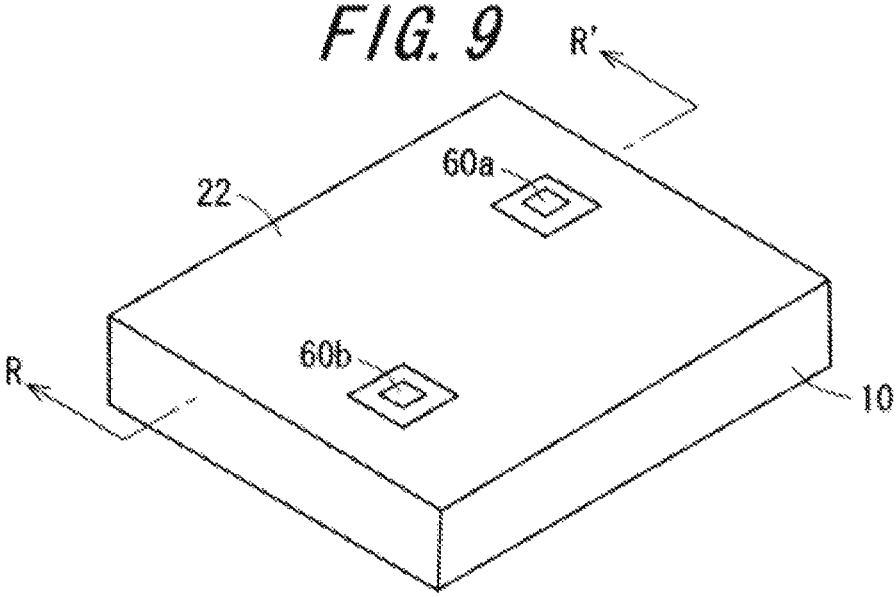
FIG. 9 is an external perspective view schematically showing the bandpass filter according to the third embodiment of the present invention.
Figure 10:
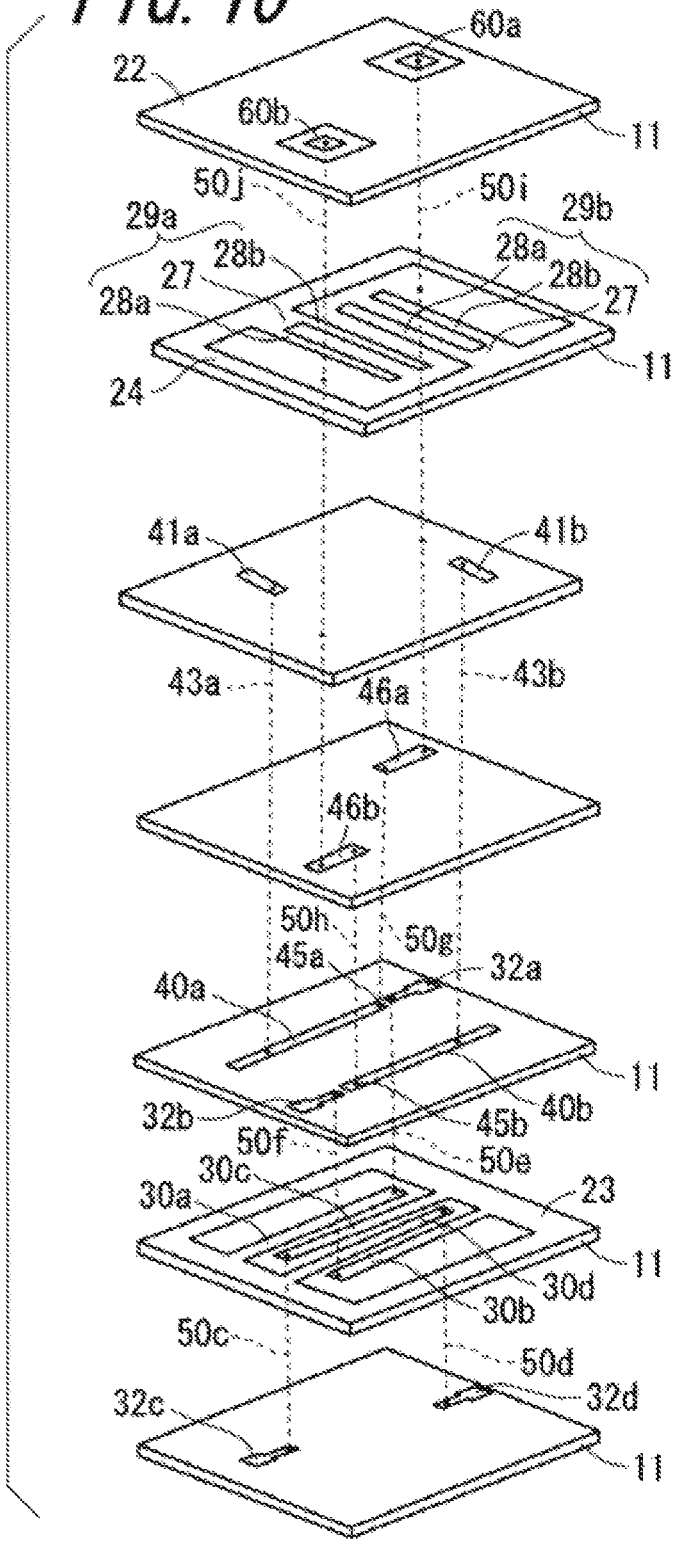
FIG. 10 is a schematic exploded perspective view of the bandpass filter shown in FIG. 9.
Figure 11:
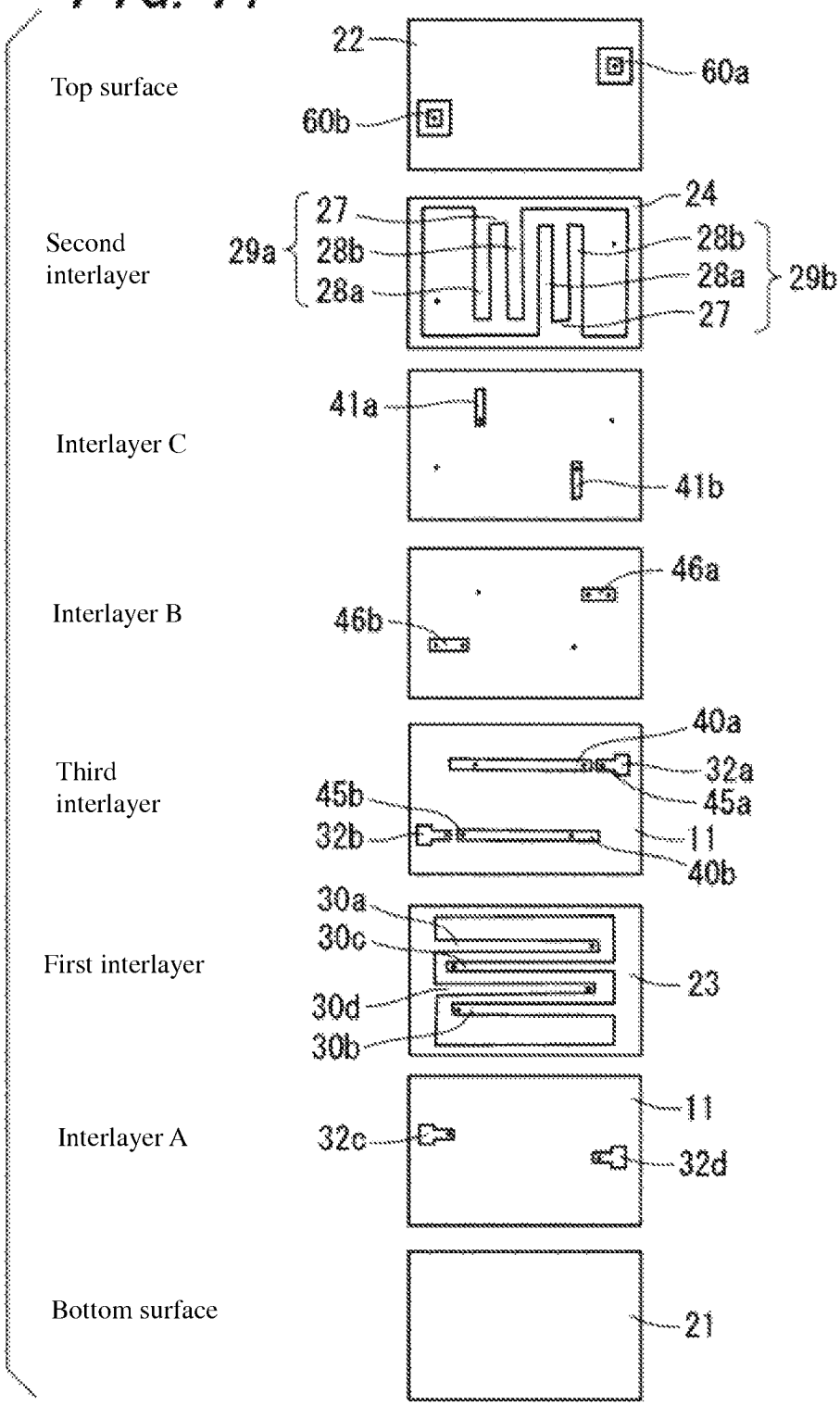
FIG. 11 is a plain view schematically showing the top and bottom surfaces and interlayer of the bandpass filter shown in FIG. 9.
Figure 12:
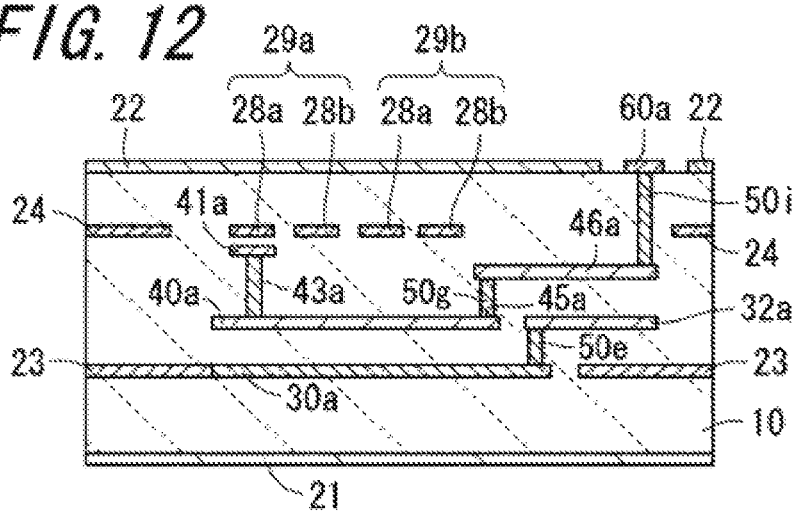
FIG. 12 is a cross-sectional view taken from the line R-R' shown in FIG. 9.

FIG. 9 is an external perspective view schematically showing the bandpass filter according to the third embodiment of the present invention. FIG. 10 is a schematic exploded perspective view of the bandpass filter shown in FIG. 9. FIG. 11 is a plain view schematically showing the top and bottom surfaces and interlayer of the bandpass filter shown in FIG. 9. FIG. 12 is a cross-sectional view taken from the line R-R' shown in FIG. 9. In addition, in this embodiment, only aspects different from the abovementioned first embodiment will be explained so as to omit redundant explanations, and the same reference characters are used for similar components.

In the bandpass filter of this embodiment, as shown in FIG. 9 through FIG. 12, the input coupling auxiliary electrode 46*a* and the output coupling auxiliary electrode 46*b* are disposed on an interlayer B located between the second interlayer and the third interlayer of the laminated body 10. The second input coupling electrode 41*a* and the second output coupling electrode 41*b* are disposed on the interlayer C located between the second layer and the interlayer B of the laminated body 10, the second input coupling electrode 41*a* is connected to the first input coupling electrode 40*a* via the input side connecting conductor 43*a*, and the second output coupling electrode 41*b* is connected to the first output coupling electrode 40*b* via the output side connecting conductor 43*b*.

According to the bandpass filter of this embodiment comprising such a structure, the second input coupling electrode 41*a* is disposed on the interlayer C that is in the closer vicinity of the second interlayer than the third interlayer; hence, the interval between the first input coupling electrode 40*a* and the single resonance electrode 30*a* on the input stage and the interval between the second input coupling electrode 41*a* and the complex resonance electrode 29*a* on the input stage are maintained, while the interval between the single resonance electrode 30*a* on the input stage and the complex resonance electrode 29*a* on the input stage can be widened. Therefore, without weakening the electromagnetic coupling of the first input coupling electrode 40*a* to the single resonance electrode 30*a* on the input stage and the electromagnetic coupling of the second input coupling electrode 41*a* to the complex resonance electrode 29*a* on the input stage, the electromagnetic coupling of the single resonance electrode 30*a* on the input stage to the complex resonance electrode on the input stage 29*a* can be weakened, and in this way, the electromagnetic coupling of the first input coupling electrode 40*a* to the single resonance electrode 30*a* on the input stage and the electromagnetic coupling of the second input coupling electrode 41*a* to the complex resonance electrode 29*a* on the input stage can be further strengthened.

Additionally, according to the bandpass filter of this embodiment, because the second output coupling electrode 41*b* is disposed on the interlayer C that is in the closer vicinity of the second interlayer than the third interlayer, the interval between the first output coupling electrode 40*b* and the single resonance electrode 30*b* on the output stage, and the interval between the second output coupling electrode 41*b* and the complex resonance electrode 29*b* on the output stage are maintained, while the interval between the single resonance electrode 30*b* on the output stage and the complex resonance electrode 29*b* on the output stage can be widened. Therefore, without weakening the electromagnetic coupling of the first output coupling electrode 40*b* to the single resonance electrode 30*b* on the output stage, and the electromagnetic coupling of the second output coupling electrode 41*b* to the complex resonance electrode 29*b* on the output stage, the electromagnetic coupling of the single resonance electrode 30*b* on the output stage with the complex resonance electrode 29*b* on the output stage can be weakened, and in this way, the electromagnetic coupling of the first output coupling electrode 40*b* to the single resonance electrode 30*b* on the output stage, and the electromagnetic coupling of the second output coupling electrode 41*b* to the complex resonance electrode 29*b* on the output stage can be further strengthened.

Fourth Embodiment

Figure 13:
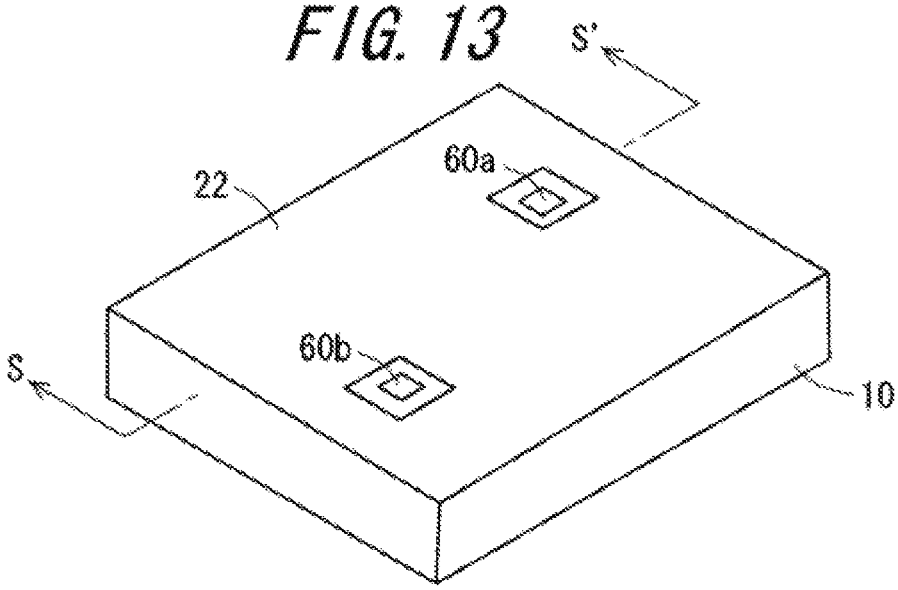
FIG. 13 is an external perspective view schematically showing the bandpass filter according to the fourth embodiment of the present invention.
Figure 14:
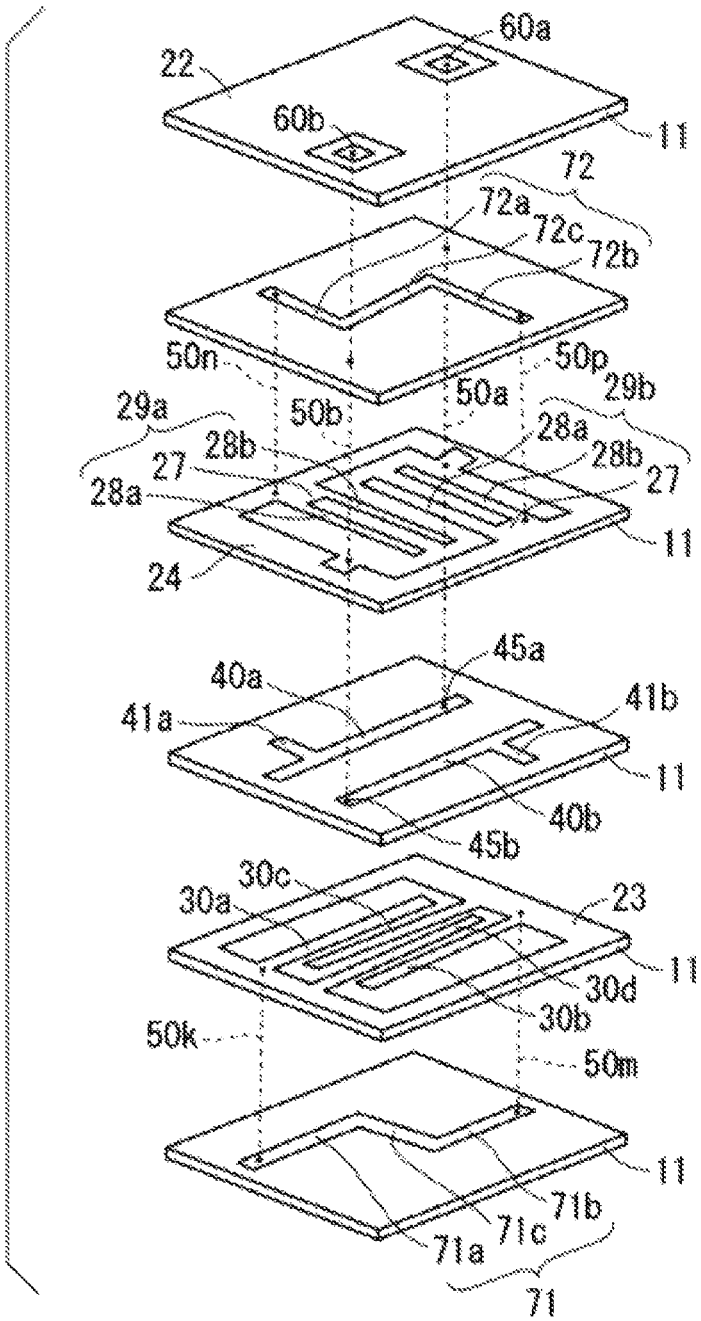
FIG. 14 is a schematic exploded perspective view of the bandpass filter shown in FIG. 13.
Figure 15:
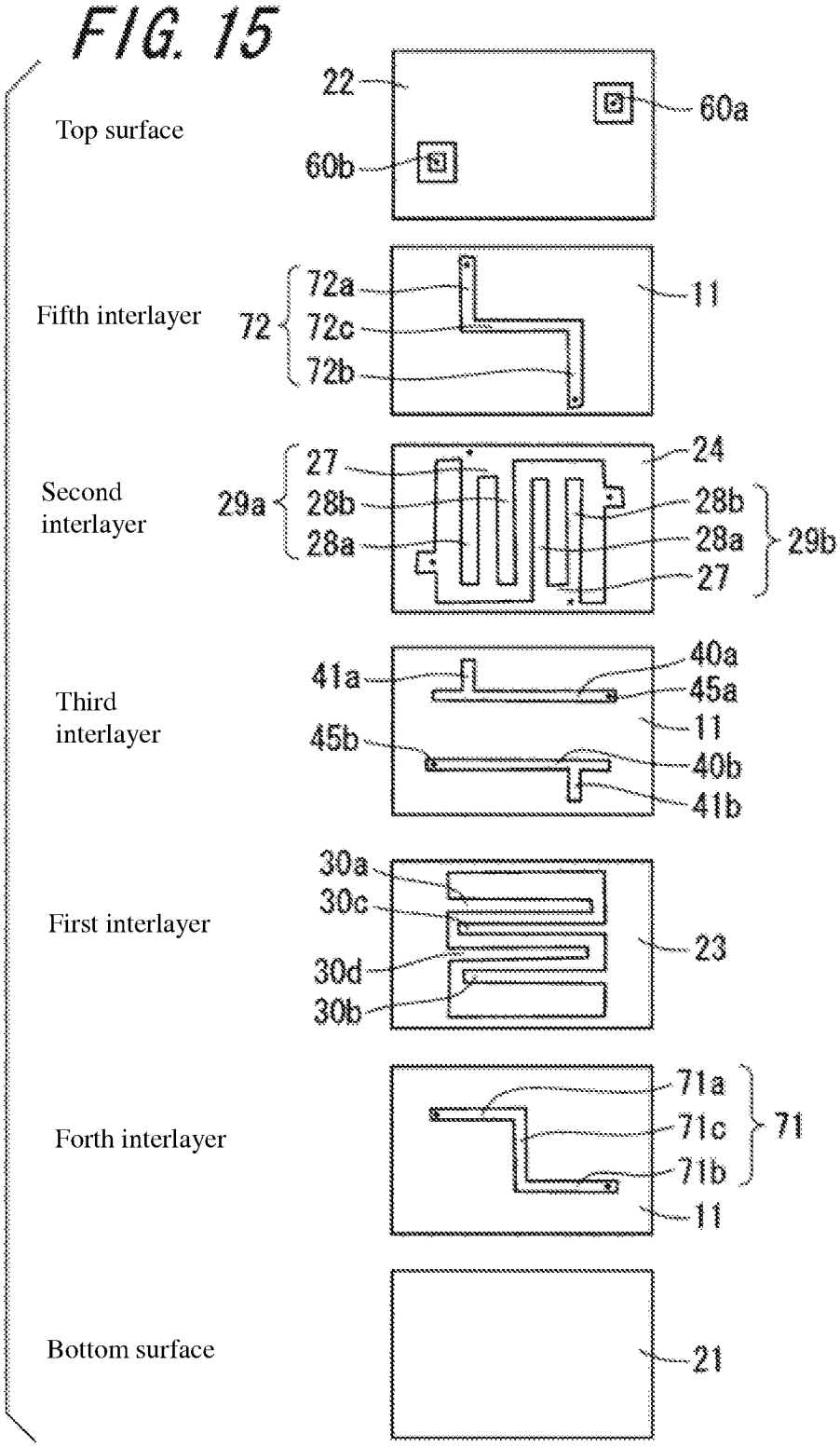
FIG. 15 is a plain view schematically showing the top and bottom surfaces and interlayer of the bandpass filter shown in FIG. 13.
Figure 16:
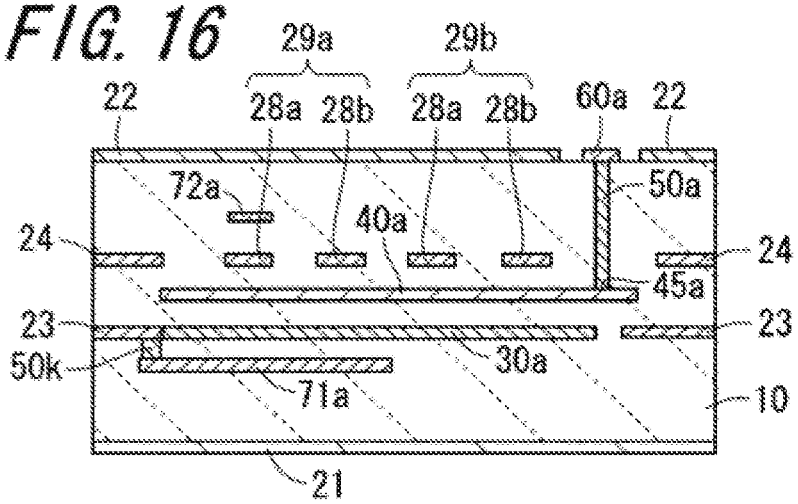
FIG. 16 is a cross-sectional view taken from the line S-S' shown in FIG. 13.

FIG. 13 is an external perspective view schematically showing the bandpass filter according to the fourth embodiment of the present invention. FIG. 14 is a schematic exploded perspective view of the bandpass filter shown in FIG. 13. FIG. 15 is a plain view schematically showing the top and bottom surfaces and interlayer of the bandpass filter shown in FIG. 13. FIG. 16 is a cross-sectional view taken from the line S-S' shown in FIG. 13. In addition, in this embodiment, only aspects different from the abovementioned first embodiment will be explained so as to omit redundant explanations, and the same reference characters are used for similar components.

The bandpass filter of this embodiment, as shown in FIG. 13 to FIG. 16, comprises a single resonance electrode coupling conductor 71 and a complex resonance electrode coupling conductor 72. The single resonance electrode coupling conductor 71 is disposed on a fourth interlayer located at the opposite side from the third interlayer sandwiching the first interlayer of the laminated body 10 in between. The single resonance electrode coupling conductor 71 has a region in which one end thereof is grounded in the vicinity of one end of the single resonance electrode on the foremost stage 30*a* constituting a single resonance electrode group comprising the four adjacent single resonance electrodes 30*a*, 30*b*, 30*c*, 30*d*, the other end thereof is grounded in the vicinity of one end of the single resonance electrode on the rearmost stage 30*b* constituting the single resonance electrode group, and that is facing each of the single resonance electrode 30*a* on the foremost stage and the resonance electrode 30*b* on the rearmost stage, and electromagnetically coupled to the single resonance electrode 30*a* and the resonance electrode 30*b*. The complex resonance electrode coupling conductor 72 is disposed on a fifth interlayer located on the opposite side from the third interlayer sandwiching the second interlayer of the laminated body 10 in between. The complex resonance electrode coupling conductor 72 has a region, in which one end thereof is grounded in the vicinity of one end of the protruding portion 28*a* on the input stage of the complex resonance electrode 29*a* on the foremost stage constituting a complex resonance electrode group comprising adjacent two complex resonance electrodes 29*a*, 29*b* disposed so as to alternate one end and the other end, the other end thereof is grounded in the vicinity of one end of the protruding portion 28*b* on the output stage of the complex resonance electrode 29*b* on the rearmost stage constituting a complex resonance electrode group, and that is facing each of the protruding portion 28*a* on the input stage of the complex resonance electrode 29*a* on the foremost stage and the one end side of the protruding portion 28*b* on the output stage of the complex resonance electrode 29*b* on the rearmost stage, and electromagnetically coupled to the protruding portion 28*a* and the one end side of the protruding portion 28*b*. Both end portions of the single resonance electrode coupling conductor 71 are each connected to the first annular ground electrode 23 via through-conductors 50*k*, 50*m*, and both end portions of the complex resonance electrode coupling conductor 72 are connected to the second annular ground electrode 24 respectively via through-conductors 50*n*, 50*p*.

According to the bandpass filter of this embodiment, comprising the single resonance electrode coupling conductor 71 comprising such a configuration, can cause a phenomenon between the single resonance electrode 30*a* on the foremost stage and the single resonance electrode 30*b* on the rearmost stage of the single resonance electrode group, which cancels signals transmitted by an inductive coupling via the single resonance electrode coupling conductor 71 and signals transmitted by a capacitive coupling via the adjacent single resonance electrodes, due to a 180° phase difference generated between the signals. Accordingly, in the bandpass characteristics of the bandpass filter, an attenuation pole can be formed, in which little signals are transmitted in the vicinity of the both sides of the passband formed by the single resonance electrode.

An even number of four or more, of the single resonance electrodes constituting the single resonance electrode group are required to develop the abovementioned effects. For example, if the number of the single resonance electrode constituting the single resonance electrode group is an odd number, the phenomenon, which cancels the signals transmitted by an inductive coupling via the single resonance electrode coupling conductor and the signals transmitted by a capacitive coupling via the adjacent single resonance electrodes due to a 180° phase difference generated between the signals, is only generated at the higher frequency side than the passband of the bandpass filter even if the inductive coupling via the single resonance electrode coupling conductor is generated between the single resonance electrode on the foremost stage and the single resonance electrode on the rearmost stage; hence, the attenuation pole cannot be formed in the vicinity of the both sides of the passband in the bandpass characteristics of the bandpass filter. Additionally, if the number of the single resonance electrode constituting the single resonance electrode group is two, an LC parallel resonant circuit with the inductive coupling and the capacitive coupling can be only formed between the single resonance electrodes, only one attenuation pole is thereby formed; therefore, the attenuation pole cannot be formed in the vicinity of the both sides of the passband.

Additionally, according to the bandpass filter of this embodiment, comprising the complex resonance electrode coupling conductor 72 comprising such a configuration, can cause a phenomenon, which cancels signals transmitted by an inductive coupling via the complex resonance electrode coupling conductor 72 and signals transmitted by a capacitive coupling via the adjacent complex resonance electrodes due to a 180° phase difference generated between the signals, between the protruding portion 28*a* on the input stage of the complex resonance electrode 29*a* on the foremost stage, and the protruding portion 28*b* on the output stage of the complex resonance on the rearmost stage 29*b* of the complex electrode group. Accordingly, an attenuation pole can be formed, in which little signals are transmitted in the vicinity of the both sides of the passband formed by the complex resonance electrode in the bandpass characteristics of the bandpass filter.

Furthermore, according to the bandpass filter of this embodiment, the single resonance electrode coupling conductor 71 comprises a strip-shaped preceding-stage side coupling region 71*a* that, in parallel, faces the single resonance electrode 30*a* on the foremost stage, a strip-shaped subsequent-stage side coupling region 71*b* that, in parallel, faces the single resonance electrode 30*b* on the rearmost stage, and a connection region 71*c* for connecting the preceding-stage side coupling region 71*a* and the subsequent-stage side coupling region 71*b* so that these regions are orthogonal to each other. Accordingly, the magnetic coupling of the preceding-stage side coupling region 71*a* to the single resonance electrode 30*a* on the foremost stage and the magnetic coupling of the subsequent-stage side coupling region 71*b* to the single resonance electrode 30*b* on the rearmost stage can be strengthened respectively. Additionally, the magnetic coupling of the single resonance electrode 30*a* on the foremost stage and the single resonance electrode 30*b* on the rearmost stage, and the single resonance electrode located between them to the connection region 71*c* can be minimized; hence, deterioration of the electrical characteristics can be minimized due to unintended electromagnetic coupling between the single resonance electrodes via the connection region 71*c*.

Furthermore, according to the bandpass filter of this embodiment, the complex resonance electrode coupling conductor 72 comprises a strip-shaped second preceding-stage side coupling region 72*a* that, in parallel, faces the protruding portion 28*a* on the input stage of the complex resonance electrode 29*a* on the foremost stage, a strip-shaped second subsequent-stage side coupling region 72*b* that, in parallel, faces the protruding portion 28*b* on the input stage of the complex resonance electrode 29*b* on the rearmost stage, and a second connection region 72*c* for connecting the second preceding-stage side coupling region 72*a* and the second subsequent-stage side coupling region 72*b*. The second connection region 72*c* is connected to these regions in orthogonal Direction. Accordingly, the magnetic coupling of the second preceding-stage side coupling region 72*a* to the protruding portion 28*a* on the input stage of the complex resonance electrode 29*a* on the foremost stage, and the magnetic coupling of the second subsequent-stage side coupling region 72*b* to the protruding portion 28*b* on the output stage of the complex resonance electrode 29*b* on the rearmost stage can be strengthened respectively. Additionally, the magnetic coupling of the protruding portion 28*a* on the input stage of the complex resonance electrode 29*a* on the foremost stage and the protruding portion 28*b* on the output stage of the complex resonance electrode 29*b* on the rearmost stage, and the protruding portion located between them to the second connection region 72*c* can be minimized; hence, deterioration of the electrical characteristics can be minimized due to unintended electromagnetic coupling between the complex resonance electrodes via the connection region 72*c*.

Furthermore, according to the bandpass filter of this embodiment, one end of the single resonance electrode coupling conductor 71 is connected to the first annular ground electrode 23 in the vicinity of one end of the single resonance electrode 30*a* on the foremost stage, constituting the single resonance electrode group, via the through-conductor 50*k*, and the other end thereof is connected to the first annular ground electrode 23 in the vicinity of one end of the single resonance electrode 30*b* on the rearmost stage, constituting the single resonance electrode group, via the through-conductor 50*m*. Therefore, compared to the case in which the both sides of the single resonance electrode coupling conductor 71 are connected to the first ground electrode 21 or to the second ground electrode 22 and thus grounded, the electromagnetic coupling of the single resonance electrode 30*a* on the foremost stage, constituting the single resonance electrode group to the single resonance electrode 30*b* on the rearmost stage, constituting the single resonance electrode group, via the single resonance electrode coupling conductor 71, can be further strengthened, so the attenuation pole formed on the both sides of the passband formed by the single resonance electrodes 30*a*, 30*b*, 30*c*, 30*d* can be further moved in the closer vicinity of the passband. Accordingly, attenuation in an inhibition zone in the close vicinity of the passband can be further increased.

Similarly, according to the bandpass filter of this embodiment, one end of the complex resonance electrode coupling conductor 72 is connected to the second annular ground electrode 24 in the vicinity of one end of the protruding portion 28*a* on the input stage of the complex resonance electrode 29*a* on the foremost stage, constituting the complex resonance electrode group via the through-conductor 50*n*, and the other end thereof is connected to the second annular ground electrode 24 in the vicinity of one end of the protruding portion 28*b* in the output portion of the complex resonance electrode 29*b* on the rearmost stage 29*b*, constituting the complex resonance electrode group via the through-conductor 50*p*. Therefore, as compared to the case in which the both sides of the complex resonance electrode coupling conductor 72 are connected to the first ground electrode 21 or to the second ground electrode 22 and thus grounded, the electromagnetic coupling of the protruding portion 28*a* on the input stage of the complex resonance electrode 29*a* on the foremost stage, constituting the complex resonance electrode group to the protruding portion 28*b* on the output stage of the complex resonance electrode 29*b* on the rearmost stage, constituting the complex resonance electrode group, via the complex resonance electrode coupling conductor 72, can be further strengthened; hence, the attenuation pole formed on the both sides of the passband formed by the complex resonance electrodes 29*a*, 29*b* can be further moved in the closer vicinity of the passband. Accordingly, attenuation in an inhibition zone in the vicinity of the passband can be further increased.

Fifth Embodiment

Figure 17:
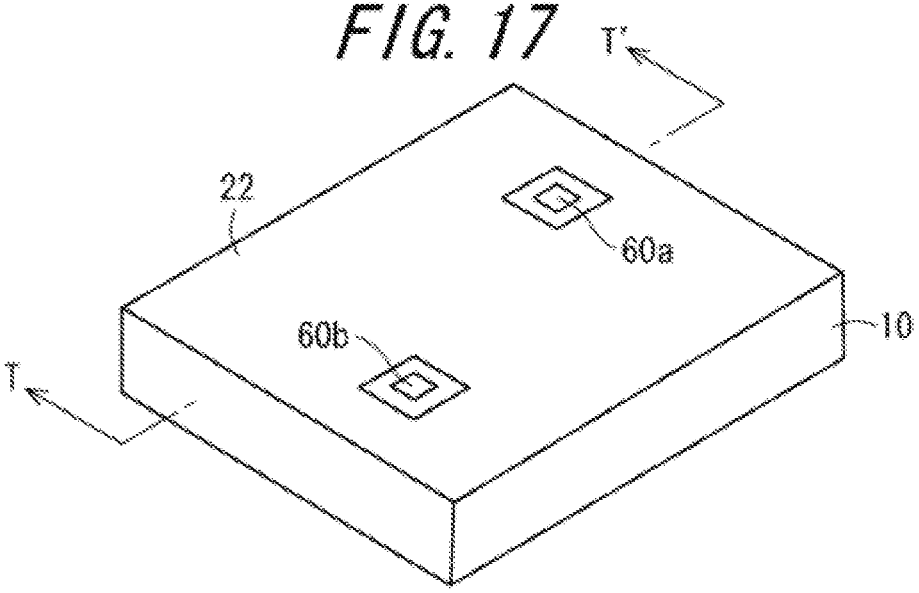
FIG. 17 is an external perspective view schematically showing the bandpass filter according to the fifth embodiment of the present invention.
Figure 18:
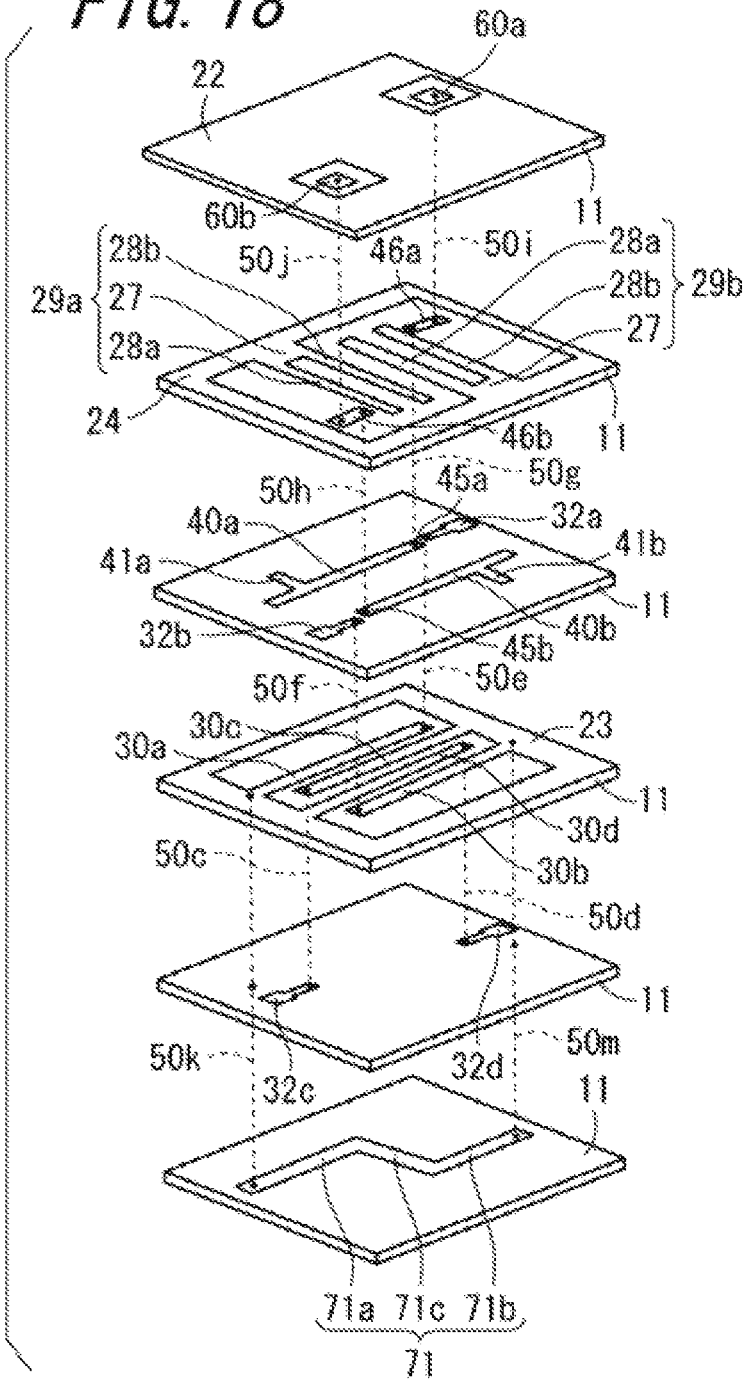
FIG. 18 is a schematic exploded perspective view of the bandpass filter shown in FIG. 17.
Figure 19:
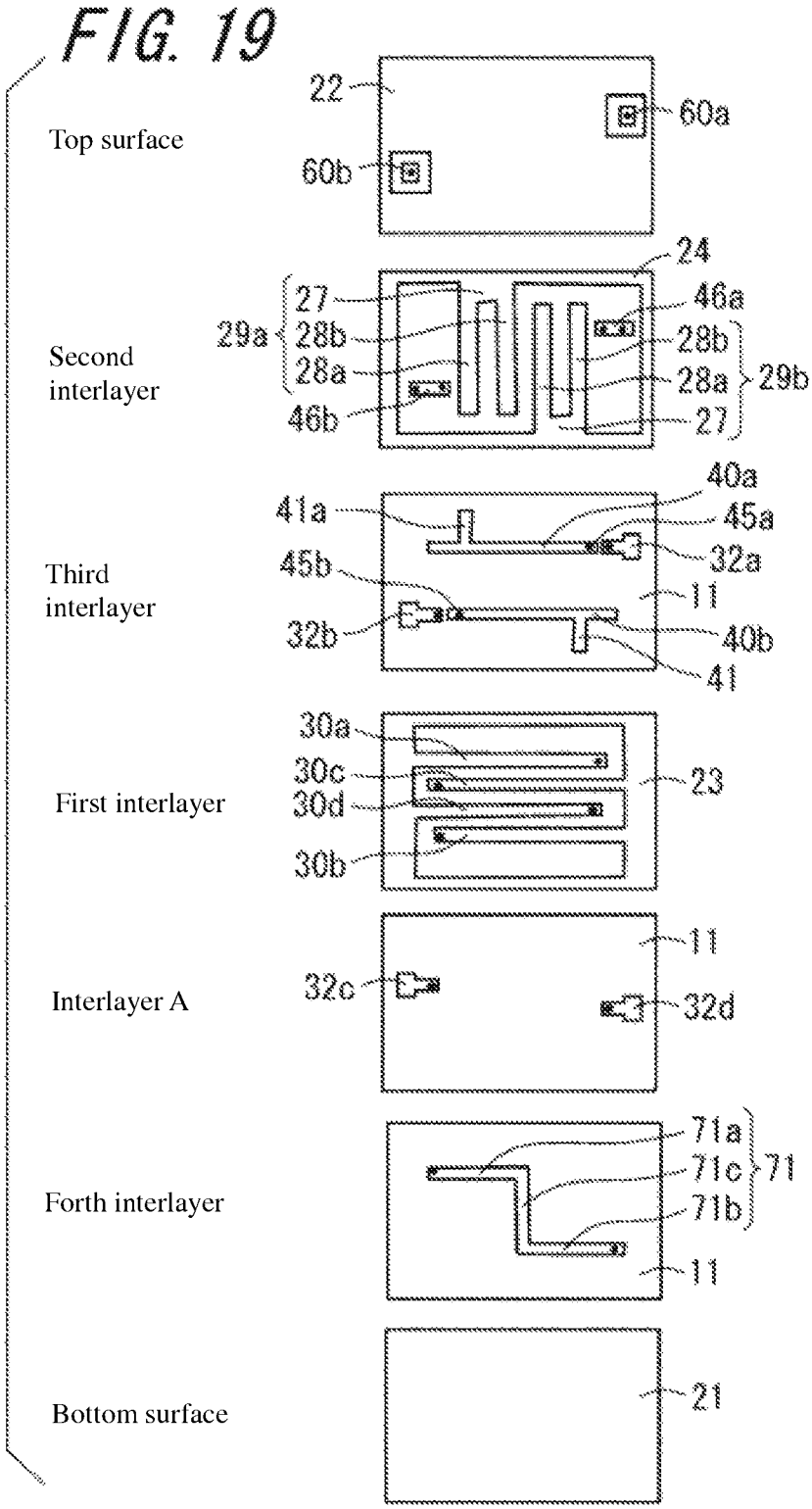
FIG. 19 is a plain view schematically showing the top and bottom surfaces and interlayer of the bandpass filter shown in FIG. 17.
Figure 20:
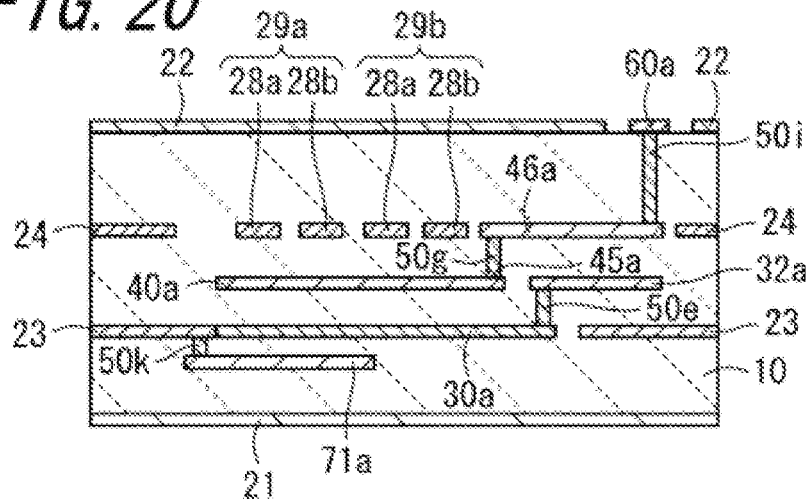
FIG. 20 is a cross-sectional view taken from the line T-T' shown in FIG. 17.

FIG. 17 is an external perspective view schematically showing the bandpass filter according to the fifth embodiment of the present invention. FIG. 18 is a schematic exploded perspective view of the bandpass filter shown in FIG. 17. FIG. 19 is a plain view schematically showing the top and bottom surfaces and interlayer of the bandpass filter shown in FIG. 17. FIG. 20 is a cross-sectional view taken from the line T-T' shown in FIG. 17. In addition, in this embodiment, only aspects different from the abovementioned forth embodiment will be explained so as to omit redundant explanations, and the same reference characters are used for similar components.

In the bandpass filter of this embodiment, as shown in FIG. 17 through FIG. 20, the resonance auxiliary electrodes 32*c*, 32*d* are disposed on the interlayer A located between the first interlayer and the fourth interlayer of the laminated body 10, which are connected to the other end side of the single resonance electrodes 30*c*, 30*d*, respectively, via the through-conductors 50*c*, 50*d*. Additionally, the resonance auxiliary electrodes 32*a*, 32*b* are disposed on the third interlayer of the laminated body 10, which are connected to the other end of the single resonance electrode 30*a*, 30*b*, respectively, via the through-conductors 50*e*, 50*f*.

Furthermore, in the bandpass filter of this embodiment, an input coupling auxiliary electrode 46*a*, in which a region facing the first input coupling electrode 40*a* is connected to the first input coupling electrode 40*a* via the through-conductor 50*g* and a region facing the resonance auxiliary electrode 32*a* is connected to the input terminal electrode 60*a* via the through-conductor 50*i*, is provided on the second interlayer of the laminated body 10. Similarly, the output coupling auxiliary electrode 46*b*, in which a region facing the first output coupling electrode 40*b* is connected to the first output coupling electrode 40*b* via the through-conductor 50*h* and a region facing the resonance auxiliary electrode 32*b* is connected to the output terminal electrode 60*b* via the through-conductor 50*j*, is provided on the interlayer C.

According to the bandpass filter of this embodiment, although the complex resonance electrode coupling conductor 72 is not provided therein, the single resonance electrode coupling conductor 71 is provided in the same manner as in the abovementioned fourth embodiment; hence, an attenuation pole can be formed in the vicinity of both low frequency side and high frequency side in the passband formed by the single resonance electrodes 30*a*, 30*b*, 30*c*, 30*d*.

Sixth Embodiment

Figure 21:
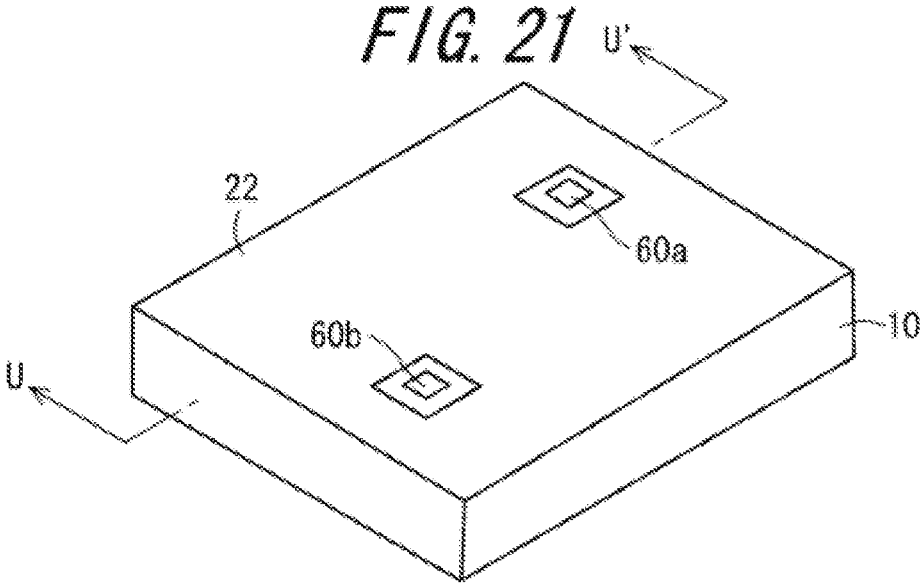
FIG. 21 is an external perspective view schematically showing the bandpass filter according to the sixth embodiment of the present invention.
Figure 22:
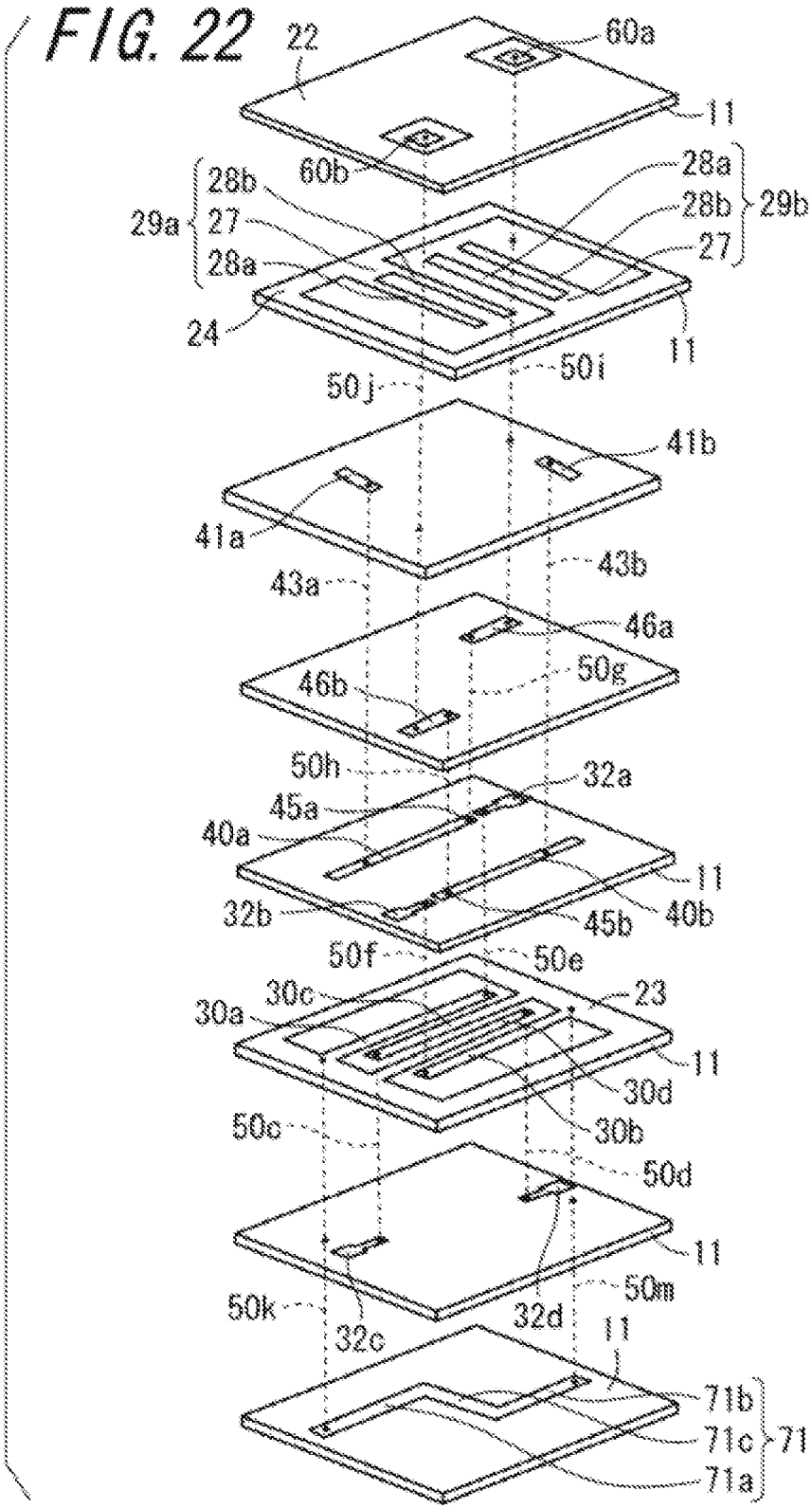
FIG. 22 is a schematic exploded perspective view of the bandpass filter shown in FIG. 21.
Figure 23:
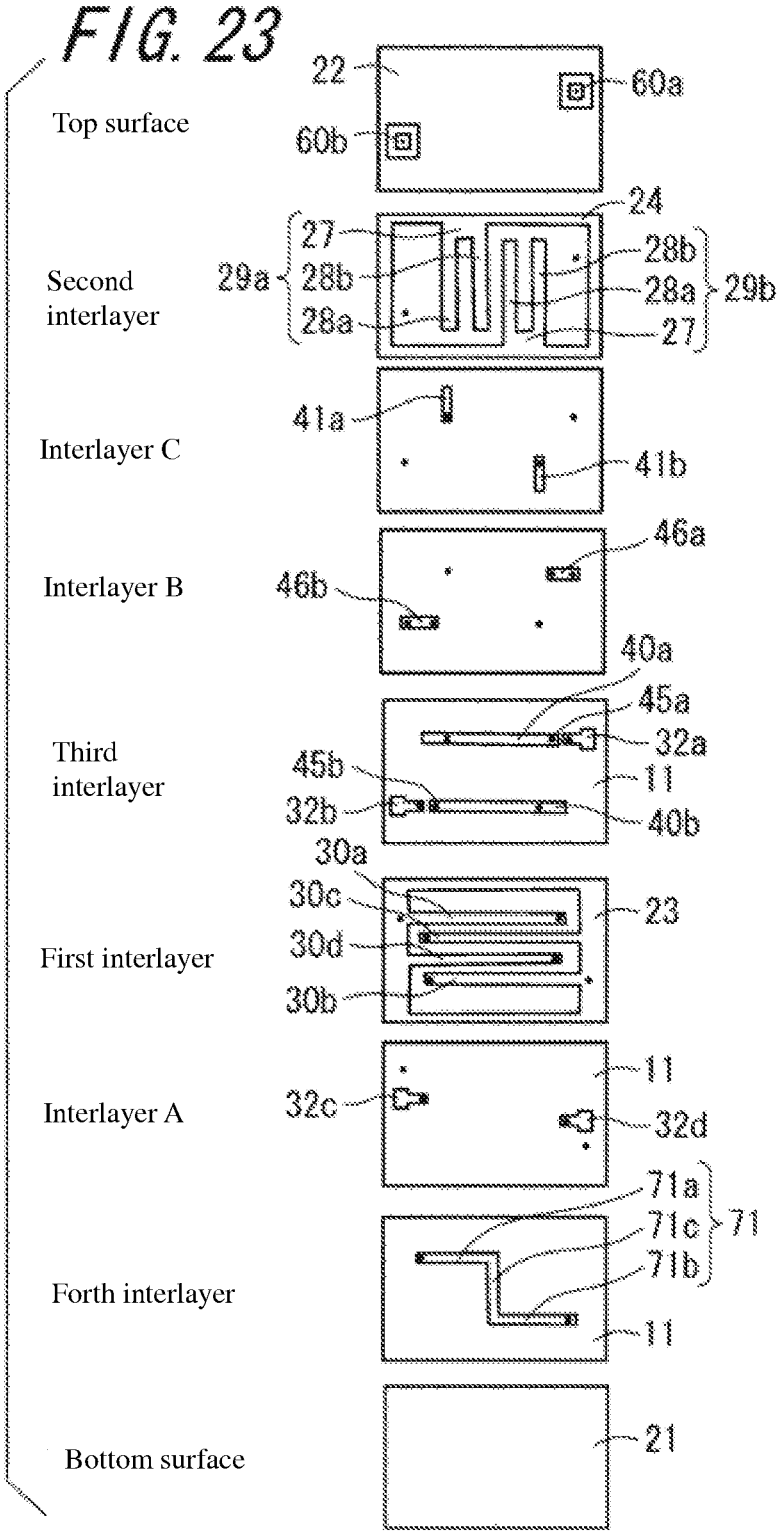
FIG. 23 is a plain view schematically showing the top and bottom surfaces and interlayer of the bandpass filter shown in FIG. 21.
Figure 24:
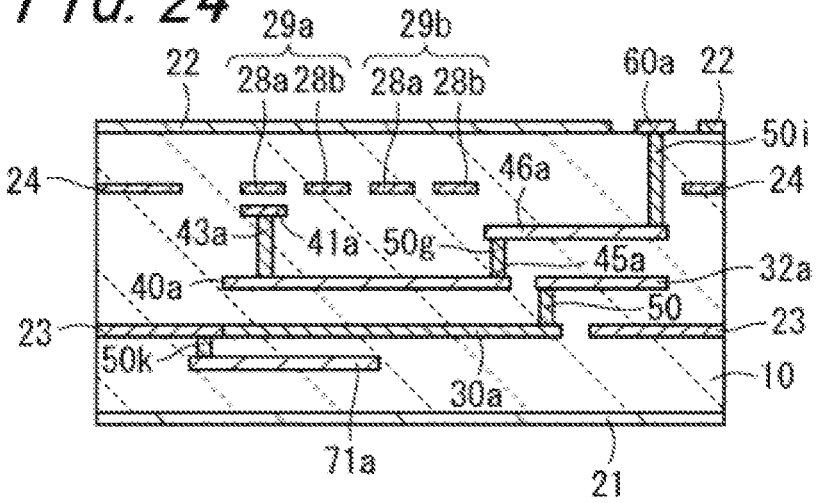
FIG. 24 is a cross-sectional view taken from the line U-U' shown in FIG. 21.

FIG. 21 is an external perspective view schematically showing the bandpass filter according to the sixth embodiment of the present invention. FIG. 22 is a schematic exploded perspective view of the bandpass filter shown in FIG. 21. FIG. 23 is a plain view schematically showing the top and bottom surfaces and interlayer of the bandpass filter shown in FIG. 21. FIG. 24 is a cross-sectional view taken from the line U-U' shown in FIG. 21. In addition, in this embodiment, only aspects different from the abovementioned fifth embodiment will be explained so as to omit redundant explanations, and the same reference characters are used for similar components.

In the bandpass filter of this embodiment, as shown in FIG. 21 through FIG. 24, the input coupling auxiliary electrode 46*a* and the output coupling auxiliary electrode 46*b* are disposed on the interlayer B located between the second interlayer and the third interlayer of the laminated body 10. Additionally, the second input coupling electrode 41*a* and the second output coupling electrode 41*b* are disposed on the interlayer C located between the second layer and the interlayer B of the laminated body 10, the second input coupling electrode 41*a* is connected to the first input coupling electrode 40*a* via the input side connecting conductor 43*a*, and the second output coupling electrode 41*b* is connected to the first output coupling electrode 40*b* via the output side connecting conductor 43*b*.

According to the bandpass filter of this embodiment comprising such a structure, the second input coupling electrode 41*a* is disposed on the interlayer C that is in the closer vicinity of the second interlayer than the third interlayer; hence, the electromagnetic coupling of the first input coupling electrode 40*a* to the single resonance electrode 30*a* on the input stage and the electromagnetic coupling of the second input coupling electrode 41*a* to the complex resonance electrode 29*a* on the input stage can be further strengthened in the same manner as in the abovementioned bandpass filter of the third embodiment.

Additionally, according to the bandpass filter of this embodiment, the second output coupling electrode 41*b* is disposed on the interlayer C that is in the closer vicinity of the second interlayer than the third interlayer; hence, the electromagnetic coupling of the first output coupling electrode 40*b* to the single resonance electrode 30*b* on the output stage and the electromagnetic coupling of the second output coupling electrode 41*b* to the complex resonance electrode 29*b* on the output stage can be further strengthened in the same manner as in the abovementioned bandpass filter of the third embodiment.

Seventh Embodiment

Figure 25:
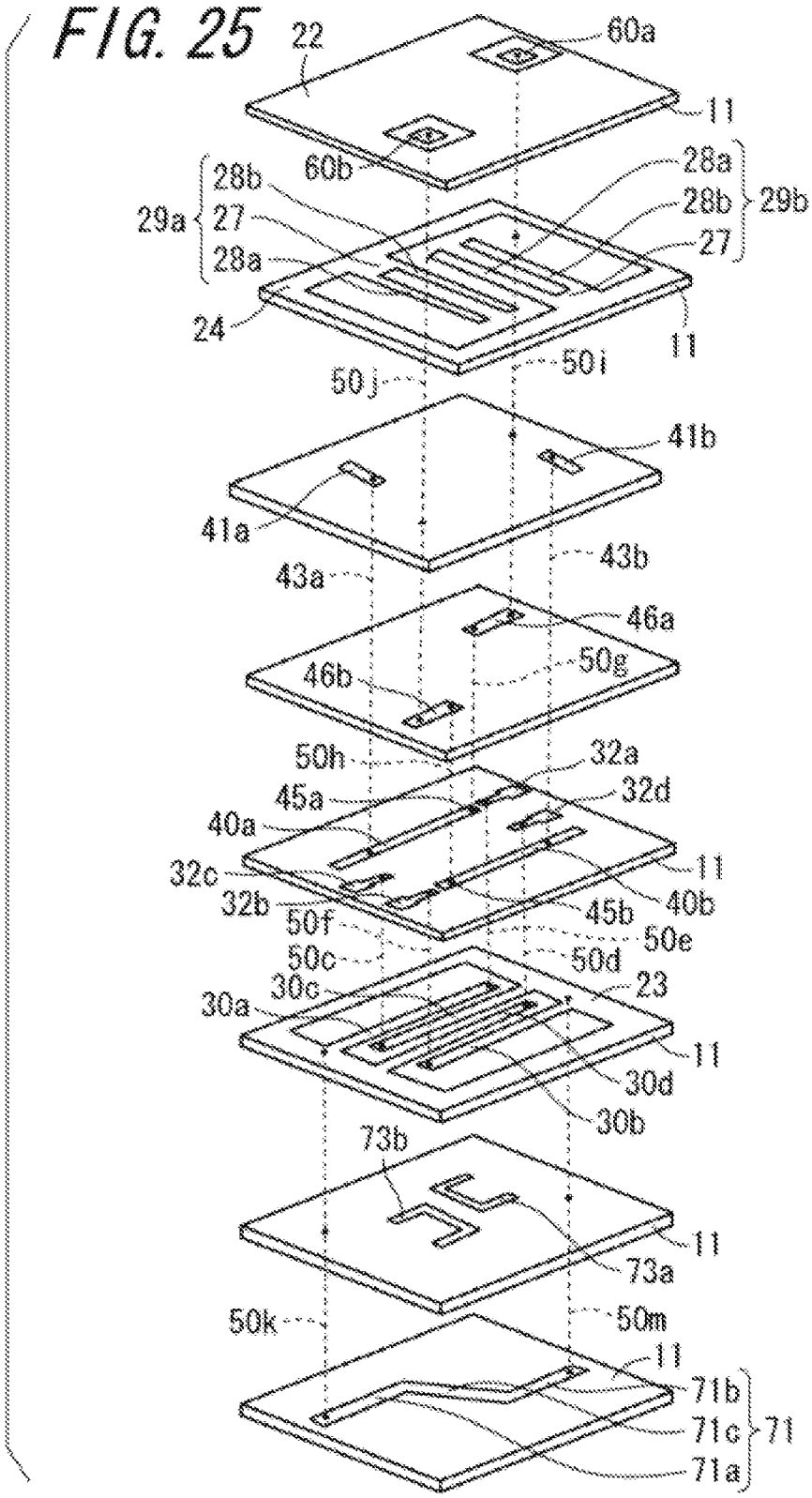
FIG. 25 is an external perspective view schematically showing the bandpass filter according to the seventh embodiment of the present invention.
Figure 26:
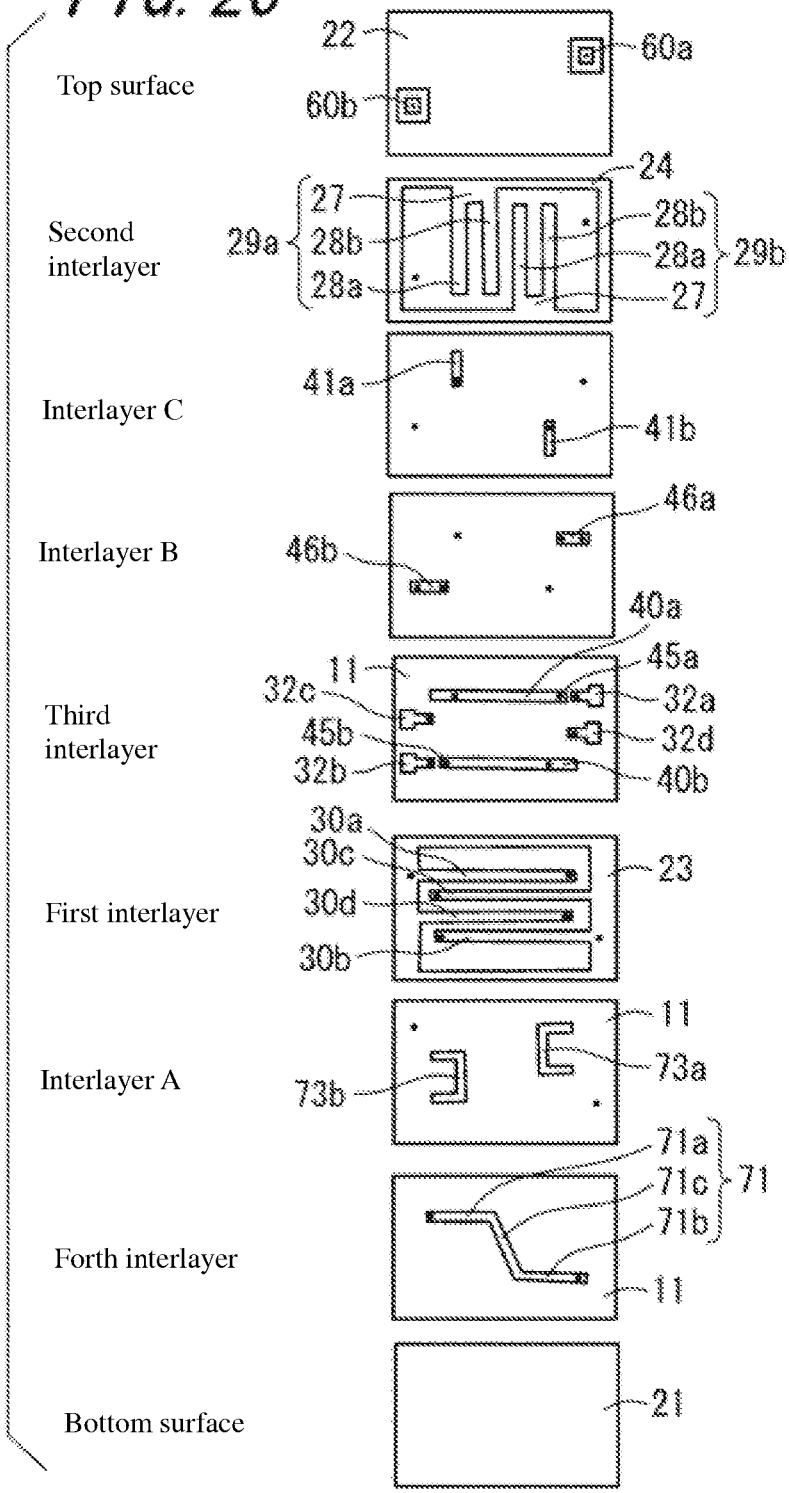
FIG. 26 is a plain view schematically showing the top and bottom surfaces and interlayer of the bandpass filter shown in FIG. 25.

FIG. 25 is an exploded perspective view schematically showing the bandpass filter according to the seventh embodiment of the present invention. FIG. 26 is a plain view schematically showing the top and bottom surfaces and interlayer of the bandpass filter shown in FIG. 25. In addition, in this embodiment, only aspects different from the abovementioned sixth embodiment will be explained so as to omit redundant explanations, and the same reference characters are used for similar components.

In the bandpass filter of this embodiment, as shown in FIG. 25 and FIG. 26, all of the resonance auxiliary electrode 32*a*, 32*b*, 32*c*, 32*d* are disposed on the third interlayer of the laminated body 10. Additionally, in the interlayer A of laminated body 10, a first capacitive coupling electrode 73*a* that faces and capacitively-couples to the other end of the single resonance electrodes 30*a* and 30*d* respectively, and a second capacitive coupling electrode 73*b* that faces and capacitively-couples to the other end of the single resonance electrodes 30*b* and 30*c* respectively, are provided. Furthermore, in the single resonance electrode coupling conductor 71, the connection region 71*c* connects both the preceding-stage side coupling region 71*a* and the subsequent-stage side coupling region 71*b* so as to intersect diagonally with them.

In the bandpass filter of this embodiment comprising such a configuration, the first capacitive coupling electrode 73*a* and the second capacitive coupling electrode 73*b* are provided, resulting in easier adjustment of a combined state between the resonance electrodes; therefore, resulting in easier adjustment of the electrical characteristics of the filter.

Eighth Embodiment

Figure 27:
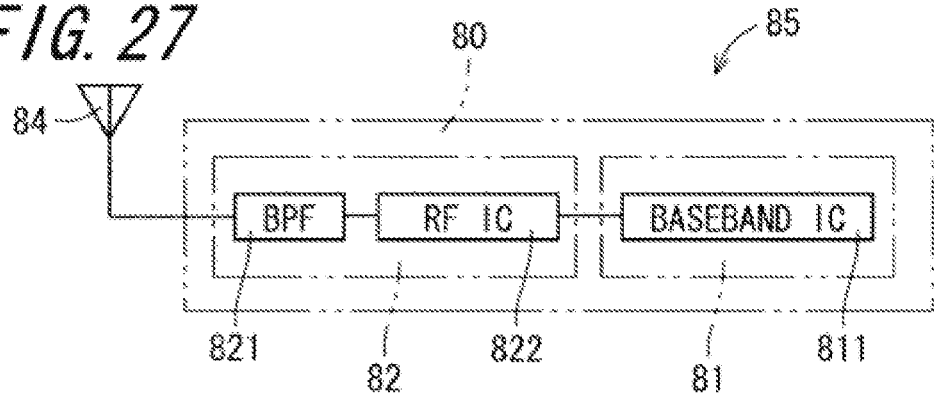
FIG. 27 is a block diagram showing a constitutional example of a wireless communication module and a wireless communication device according to the eighth embodiment of the present invention.

FIG. 27 is a block diagram showing an example configuration of a wireless communication module 80 and a wireless communication device 85 according to the eighth embodiment of the present invention.

The wireless communication module 80 of this invention comprises, for example, a baseband portion 81, in which baseband signals are processed, and an RF portion 82, which is connected to the baseband portion 81 and in which baseband signals after modulation and RF signals before demodulation are processed. The RF portion 82 comprises a bandpass filter 821 of any of the abovementioned first through seventh embodiments of the present invention, wherein RF signals that are made from modulated baseband signals or signals other than the signals at communication bands in the received RF signals are attenuated via the bandpass filter 821. As a specific configuration, on the baseband portion 81, a baseband IC 811 is disposed, and on the RF portion 82, an RF IC 822 is disposed between the bandpass filter 821 and the baseband portion 81. In addition, another circuit may be interposed between these circuits. In turn, an antenna 84 is connected to the bandpass filter 821 of the wireless communication module 80, thus configuring a wireless communication device 85 of this embodiment to transmit and receive RF signals.

According to the wireless communication module 80 and the wireless communication device 85 of this embodiment comprising such a configuration, the bandpass filter 821 of any of the first to the third embodiments of the present invention with small signal loss, in which the signals passes across the entire frequency band used for communication, is used for filtering waves of transmitted signals and received signals, resulting in less attenuation of transmitted signals and received signals that pass the bandpass filter 821; hence, the reception sensitivity increases, and in addition, the amplification of transmitted signals and received signals can be small, resulting in less power consumption in the amplifier circuit. Therefore, an enhanced wireless communication module 80 and wireless communication device 85 with high receiving sensitivity and low power consumption can be obtained. Furthermore, using the bandpass filter of any of the first to the third embodiments of the present invention, in which two communication bands can be covered by one filter and excellent filter characteristics can be obtained even if it is thinned, the wireless communication module 80 and the wireless communication device 85 with small size and low manufacturing cost can be obtained.

Additionally, according to the wireless communication module 80 and the wireless communication device 85 of this embodiment, the bandpass filter 821 of any of the fourth to the seventh embodiment of the present invention in which input impedance is well matched across the entire frequency band used for communication and small signal loss is obtained, and attenuation in an inhibit zone is sufficiently ensured by the attenuation pole formed in the close vicinity of a passband, is used for filtering waves of transmitted signals and received signals, resulting in less attenuation of transmitted signals and received signals that pass the bandpass filter 821; hence, the reception sensitivity is increased, and in addition, the amplification of transmitted signals and received signals can be small, resulting in less power consumption in the amplifier circuit. Therefore, an enhanced wireless communication module 80 and wireless communication device 85 with high receiving sensitivity and low power consumption can be obtained.

In the abovementioned bandpass filter of the first to the seventh embodiments, as the material for the dielectric layer 11, for example, resins such as epoxy, or ceramics such as dielectric ceramics may be used. For example, glass-ceramic materials that comprise dielectric ceramics materials such as $BaTiO_3$, $Pb_4Fe_2Nb_2O_{12}$, $TiO_2$ and glass materials such as $B_2O_3$, $SiO_2$, $Al_2O_3$, ZnO and can be fired at relatively lower temperatures of approximately 800 to 1,200° C. are preferably used. Additionally, the thickness of the dielectric layer 11 is set to be approximately 0.01 to 0.1 mm, for example.

As the materials for the abovementioned various types of electrodes and through-conductors, for example, conductive materials composed mostly of Ag alloys such as Ag, Ag—Pd, Ag—Pt or Cu, W, Mo, Pd-based conductive materials are preferably used. The thickness of various types of electrodes is set to be 0.001 to 0.2 mm, for example.

The abovementioned bandpass filter of the first to the seventh embodiments can be manufactured as follows, for example. Firstly, slurry is made by adding and mixing an appropriated organic solvent, etc. into ceramic raw powder, and a ceramic green sheet is formed by using the doctor blade method. Subsequently, through-holes to form through-conductors are created on the resulting ceramic green sheet by using a punching machine, etc. and filled with conductor paste containing conductors such as Ag, Ag—Pd, Au, or Cu, and ceramic green sheets with conductor paste are created by applying the same conductor paste, as the above, on the surface of the ceramic green sheet by using the printing method. Then, these ceramic green sheets with conductor paste are laminated, compressed by using a hot pressing device, and fired at a peak temperature of approximately 800° C. to 1,050° C.

(Variations)

The present invention is not limited to the abovementioned first to eighth embodiments, but rather, a variety of changes and modification may be made without departing from the scope of the present invention.

For example, in the abovementioned first to the seventh embodiments, while examples of comprising the input terminal electrode 60*a* and the input terminal electrode 60*b* are shown, if the bandpass filter is formed within a region of a module substrate, the input terminal electrode 60*a* and the output terminal electrode 60*b* are not necessarily necessary, and a wiring conductor within the substrate from the external circuit may be directly connected to the first input coupling electrode 40*a* and the first output coupling electrode 40*b*. In this case, the connection points of the first output coupling electrode 40*a* and the first output coupling electrode 40*b* to the wiring conductor are the electrical signal output point 45*a* of the first electrical coupling electrode 40*a* and the electrical signal output point 45*b* of the first output coupling electrode 40*b*. Additionally, if the input coupling auxiliary electrode 46*a* and the output coupling auxiliary electrode 46*b* are provided, a wiring conductor from the external circuit may be directly connected to the input coupling auxiliary electrode 46*a* and the output coupling auxiliary electrode 46*b*.

Furthermore, in the abovementioned first to the tenth embodiments, while examples in which the first ground electrode 21 is disposed on the bottom surface of the laminated body 10 and the second ground electrode 22 is disposed on the top surface of the laminated body 10, are shown, for example, the dielectric layers may be further disposed under the first ground electrode 21, and the dielectric layers may be further disposed above the second ground electrode 22.

Furthermore, in the abovementioned first to the third embodiments, while examples comprising four single resonance electrodes 30*a*, 30*b*, 30*c*, 30*d* and two complex resonance electrodes 29*a*, 29*b* are shown, the number of single resonance electrodes and complex resonance electrodes may be changed depending on the necessary passband width and attenuation outside the passband. If the necessary passband width is narrow or the necessary attenuation outside of the passband is small, the number of resonance electrodes may be reduced, or in contrast, if the necessary passband width is wide or the necessary attenuation outside of the passband is large, etc., the number of resonance electrodes may be further increased. However, if the number of resonance electrodes increases excessively, the size becomes large and loss within the passband increases; therefore, it is desirable that the number of single resonance electrodes be set approximately 10 or fewer, and complex resonance electrodes be set five or fewer.

Furthermore, in the abovementioned fourth to the seventh embodiments, while examples comprising four single resonance electrodes 30*a*, 30*b*, 30*c*, 30*d* and that the single resonance electrode group comprises four resonance electrodes, the number of the single resonance electrode and the resonance electrodes constituting the single resonance electrode group can be set freely under the condition that the single resonance electrode group comprises an even number of four or more, of the resonance electrodes. For example, there may be six single resonance electrodes so that the single resonance electrode group is constituted of that six. Additionally, there may be six single resonance electrodes so that the single resonance electrode group is constituted by any four adjacent resonance electrodes among them. However, if the number of resonance electrodes increases excessively, the size becomes large and loss within the passband increases; therefore, it is desirable that the number of single resonance electrodes be set to approximately 10 or fewer, and complex resonance electrodes be set to five or fewer.

Furthermore, in the abovementioned first tough the third embodiments, while, in both single resonance electrodes 30*a*, 30*b*, 30*c*, 30*d* and the complex resonance electrodes 29*a*, 29*b*, examples in which each one end (ground end) of the resonance electrodes are disposed side by side alternately and they are electromagnetically coupled in an inter-digital form, are shown, if it is not necessary to be a symmetry circuit, in at least one of a plurality of single resonance electrode and a plurality of complex resonance electrode, one end of the adjacent resonance electrodes are disposed so that they are located on the same side and they are electromagnetically coupled in a comb-line form. Additionally, in at least one of a plurality of single resonance electrodes and a plurality of complex resonance electrodes, they may be disposed side by side, so that the electromagnetic coupling in a comb-line form, in which one end of the adjacent resonance electrodes is disposed so that it is located on the same side, and the electromagnetic coupling in an inter-digital form, in which one end of the adjacent resonance electrode is disposed alternately, may coexist. Additionally, in a plurality of complex resonance electrodes, a single resonance electrode may be disposed between the adjacent complex resonance electrodes so that the adjacent resonance electrodes are electromagnetically coupled via the single resonance electrode.

Furthermore, in the abovementioned fourth to the seventh embodiments, while, in both single resonance electrodes 30*a*, 30*b*, 30*c*, 30*d* and the complex resonance electrodes 29*a*, 29*b*, examples, in which each one end (ground end) of the resonance electrodes are disposed side by side alternately and electromagnetically coupled in an inter-digital form, are shown, the single resonance electrodes 30*a*, 30*c* may be electromagnetically coupled in a comb-line form, the single resonance electrode 30*b*, 30*d* may be electromagnetically coupled in a comb-line form each other, and the single resonance electrodes 30*c*, 30*d* may be electromagnetically coupled in an inter-digital form each other; therefore, also in the bandpass filter comprising such a configuration, a bandpass filter with excellent bandpass characteristics comprising an attenuation pole on both sides of each of two passbands, in which attenuation varies rapidly from the bandpass to the inhibition zone, can be obtained. Although the mechanism in this configuration has not been ascertained completely, the coupling of the resonators on the foremost stage to the resonators on the rearmost stage of the single resonance electrode group, via adjacent resonance electrodes, is considered necessary to be a capacitive coupling entirely.

Furthermore, in the abovementioned fourth to the seventh embodiments, while an example of connecting each of both end sides of the single resonance electrode coupling conductor 71 to the first annular ground electrode 23 via the through-conductors 50*k*, 50*m* is shown, and, in the abovementioned fourth embodiment, while an example of connecting each of both end sides of the complex resonance electrode coupling conductor 72 to the second annular ground electrode 24 via the through-conductors 50*n*, 50*p* is shown, for example, both end sides of the single resonance electrode coupling conductor 71 may be connected to the first ground electrode 21 via the through-conductors 50*k*, 50*m*, and both end sides of the complex resonance electrode coupling conductor 72 may be connected to the second ground electrode 22 via the through-conductors 50*n*, 50*p*. Additionally, for example, an annular ground conductor may be disposed around the single resonance electrode coupling conductor 71 and the complex resonance electrode coupling conductor 72 so as to connect both end sides of the single resonance electrode coupling conductor 71 and the complex resonance electrode coupling conductor 72 thereto. However, if it is intended to move an attenuation pole generated on both sides of a passband in the closer vicinity of the passband, these methods are less favorable.

Furthermore, in the abovementioned first to the seventh embodiments, while an example, in which the laminated body 10 is constituted of one laminated body, is shown, the laminated body 10 may be constituted of a plurality of laminated bodies that are stacked and disposed in the direction of lamination of each of the laminated body. For example, in the abovementioned bandpass filter of the first embodiment, while the laminated body 10 is constituted of a first laminated body and a second laminated body disposed thereon, the first interlayer may be an interlayer in the first laminated body, the second interlayer may be an interlayer in the second laminated body disposed on the first laminated body, and the third interlayer may be an interlayer between the first laminated body and the second laminated body. Additionally, in the abovementioned bandpass filter of the fourth embodiment, while the laminated body 10 is constituted of a first laminated body and a second laminated body disposed thereon, the first interlayer and the fourth interlayer may be an interlayer in the first laminated body, the second interlayer and the fifth interlayer are an interlayer in the second laminated body disposed on the first interlayer, and the third interlayer may be an interlayer between the first laminated body and the second laminated body.

Furthermore, while the explanation has been made based on examples of bandpass filters used for UWB, needless to say, the bandpass filter of the present invention is also useful in other applications requiring broadband.

EXAMPLES

The specific examples of the bandpass filter of this embodiment are described below.

Example 1

The electrical characteristics of the bandpass filter of the third embodiment shown in FIG. 9 to FIG. 12 are computed through a simulation by using a finite element method.

As the computation condition, the first resonance electrodes 30*a*, 30*b*, 30*c*, 30*d* are made into a rectangular that are 0.175 mm in width and 4.05 mm in length. The space between the first resonance electrode 30*a* and the first resonance electrode 30*c* and the space between the first resonance electrode 30*d* and the first resonance electrode 30*b* are each made to be 0.075 mm, and the space between the first resonance electrode 30*c* and the first resonance electrode 30*d* is made to be 0.09 mm.

The complex resonance electrode 29*a* on the input stage is structured so that the rectangular protruding portion 28*a* on the input stage that is 0.25 mm in width and 1.47 mm in length and the rectangular protruding portion on the output stage 28*b* that is 0.25 mm in width and 2.72 mm in length are disposed 0.13-mm apart from the other end of the rectangular base portion 27 that is 0.63 mm in width and 0.68 mm in length. The complex resonance electrode 29*b* on the output stage is structured so that the rectangular protruding portion 28*a* on the input stage that is 0.25 mm in width and 2.72 mm in length and the rectangular protruding portion 28*b* on the output stage that is 0.25 mm in width and 1.47 mm in length are disposed 0.13-mm apart from the other end of the rectangular base portion 27 that is 0.63 mm in width and 0.68 mm in length. Additionally, the space between the complex resonance electrode 29*a* on the input stage and the complex resonance electrode 29*b* on the output stage is made to be 0.13 mm.

The resonance auxiliary electrodes 32*a*, 32*b* are each formed so as to join a rectangle that is 0.2 mm in width and 0.25 mm in length, and disposed at a location 0.2-mm apart from the other end of the single resonance electrodes 30*a*, 30*b* with a rectangle that is 0.2 mm in width and 0.4 mm in length, and faces towards the first resonance electrodes 30*a*, 30*b*. The resonance auxiliary electrodes 32*c*, 32*d* are each formed so as to join a rectangle that is 0.29 mm in width and 0.3 mm in length, and disposed at a location 0.2-mm apart from the other end of the single resonance electrodes 30*c*, 30*d* with a rectangle that is 0.2 mm in width and 0.4 mm in length and faces towards the first resonance electrodes 30*c*, 30*d*.

The first input coupling electrode 40*a* and the first output coupling electrode 40*b* are made into a rectangular that are 0.15 mm in width and 3.7 mm in length. The second input coupling conductor 41*a* is made into a rectangular that is 0.25 mm in width and 0.6 mm in length, and connected via the input side connection conductor 43*a* at a position of 0.57 mm toward an opposite side of the electrical signal input point 45*a* from the center of the portion facing the first resonance electrode 30*a* of the first input coupling electrode 40*a*. The second output coupling conductor 41*b* is made into a rectangular that is 0.25 mm in width and 0.6 mm in length, and connected via the output side connection conductor 43*b* at a position of 0.57 mm toward an opposite side of the electrical signal output point 45*b* from the center of the portion facing the first resonance electrode 30*b* of the first output coupling electrode 40*b*. The input coupling auxiliary electrode 46*a* and the output coupling auxiliary electrode 46*b* are made into a rectangular that are 0.15 mm in width and 0.9 mm in length.

The input terminal electrode 60*a* and the output terminal electrode 60*b* are made into a square that are 0.2 mm on each side. The outlines of the first ground electrode 21, the second ground electrode 22, the first annular ground electrode 23, and the second annular ground electrode 24 are made into a rectangular that are 4 mm in width and 5 mm in length, the opening of the first annular ground electrode 23 is made into a rectangular that is 3.6 mm in width and 4.2 mm in length, and the opening of the second annular ground electrode 24 is made into a rectangular that is 3.55 mm in width and 4.2 mm in length.

The entire shape of the bandpass filter is made into a rectangular parallelepiped that is 4 mm in width, 5 mm in length, and 0.51 mm in thickness. The space between the lower surface and the interlayer A of the laminated body 10 is made to be 0.155 mm, the space between the interlayer A and the first interlayer, the space between the first interlayer and the third interlayer, the space between the third interlayer and the interlayer B, the space between the interlayer B and the interlayer C, and the space between the interlayer C and the second interlayer are made to be 0.015 mm respectively, and the space between the second interlayer and the upper surface of the laminated body 10 is made to be 0.19 mm. The thickness of each electrode is made to be 0.01 mm, and the diameter of the input side connection conductor 43*a*, and the output side connection conductor 43*b* and the through-conductor 50 are made to be 0.1 mm. The relative permittivity of the dielectric layer 11 is made to be 7.5.

Figure 28:
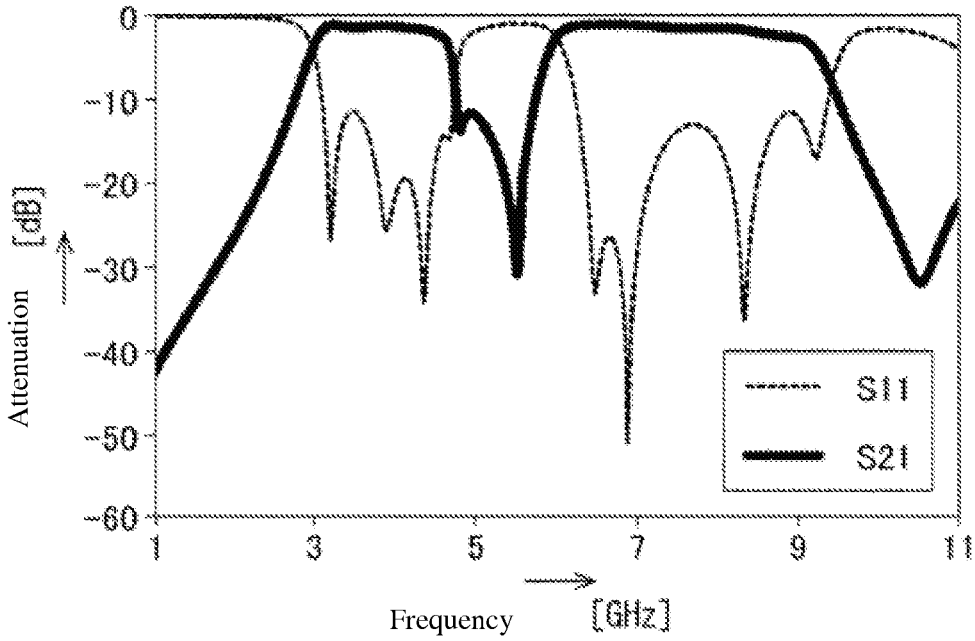
FIG. 28 is a diagram showing simulation results of electrical characteristics of the bandpass filter according to the Example 1.

FIG. 28 is a graph showing the simulation result in which the horizontal axis indicates frequency and the vertical axis indicates attenuation, showing the bandpass characteristics (S21) and reflectance characteristics (S11) of the bandpass filter. According to the graph shown in FIG. 28, although the thickness of the laminated body 10 is very thin and 0.51 mm, excellent flat and low-loss bandpass characteristics, where impedance is well matched, can be obtained across the two very wide passbands. Based on this result, according to the bandpass filter of Example 1, even if it has a very thin shape, excellent flat and low-loss bandpass characteristics can be obtained across the two wide passbands, where the effectiveness of the present invention was observed. Also in the bandpass filter of the first embodiment shown in FIG. 1 to FIG. 4 and the bandpass filter of the second embodiment shown in FIG. 5 to FIG. 8, it was observed that approximately the same bandpass characteristics can be obtained.

Example 2

The electrical characteristics of the bandpass filter of the seventh embodiment shown in FIG. 25 and FIG. 26 are computed through a simulation by using a finite element method.

As the computation condition, the first resonance electrodes 30*a*, 30*b*, 30*c*, 30*d* are made into a rectangular that are 0.175 mm in width and 4.05 mm in length. The space between the first resonance electrode 30*a* and the first resonance electrode 30*c* and the space between the first resonance electrode 30*d* and the first resonance electrode 30*b* are each made to be 0.08 mm, and the space between the first resonance electrode 30*c* and the first resonance electrode 30*d* is made to be 0.091 mm.

The complex resonance electrode 29*a* on the input stage is structured so that the rectangular protruding portion 28*a* on the input stage that is 0.25 mm in width and 1.5 mm in length and the rectangular protruding portion 28*b* on the output stage that is 0.25 mm in width and 2.75 mm in length are disposed 0.14-mm apart from the other end of the rectangular base portion 27 that is 0.64 mm in width and 0.65 mm in length. The complex resonance electrode 29*b* on the output stage is structured so that the rectangular protruding portion 28*a* on the input stage that is 0.25 mm in width and 2.75 mm in length and the rectangular protruding portion 28*b* on the output stage that is 0.25 mm in width and 1.5 mm in length are disposed 0.14-mm apart from the other end of the rectangular base portion 27 that is 0.64 mm in width and 0.65 mm in length. Additionally, the space between the complex resonance electrode 29*a* on the input stage and the complex resonance electrode 29*b* on the output stage is made to be 0.13 mm.

The resonance auxiliary electrodes 32*a*, 32*b* are formed respectively so as to join a rectangle that is 0.2 mm in width and 0.11 mm in length, and disposed at a location 0.2-mm apart from the other end of the single resonance electrodes 30*a*, 30*b* with a rectangle that is 0.2 mm in width and 0.4 mm in length and faces towards the first resonance electrodes 30*a*, 30*b*. The resonance auxiliary electrodes 32*c*, 32*d* are formed respectively so as to join a rectangle that is 0.29 mm in width and 0.3 mm in length, and disposed at a location 0.2-mm apart from the other end of the single resonance electrodes 30*c*, 30*d* with a rectangle that is 0.2 mm in width and 0.4 mm in length and faces towards the first resonance electrodes 30*c*, 30*d*.

The first input coupling electrode 40*a* and the first output coupling electrode 40*b* are made into a rectangular that are 0.15 mm in width and 3.7 mm in length. The second input coupling conductor 41*a* is made into a rectangular that is 0.25 mm in width and 0.5 mm in length, and connected via the input side connection conductor 43*a* at a position of 0.58 mm toward an opposite side of the electrical signal input point 45*a* from the center of the portion facing the first resonance electrode 30*a* of the first input coupling electrode 40*a*. The second output coupling conductor 41*b* is made into a rectangular that is 0.25 mm in width and 0.5 mm in length, and connected via the output side connection conductor 43*b* at a position of 0.58 mm toward an opposite side of the electrical signal output point 45*b* from the center of the portion facing the first resonance electrode 30*b* of the first output coupling electrode 40*b*. The input coupling auxiliary electrode 46*a* and the output coupling auxiliary electrode 46*b* are made into a rectangular that are 0.15 mm in width and 0.9 mm in length. The input terminal electrode 60*a* and the output terminal electrode 60*b* are made into a square that are 0.2 mm on each side.

The preceding-stage side coupling region 71*a* and the subsequent-stage side coupling region 71*b* are made into a rectangular that are 0.1 mm in width and 1.65 mm in length, and the connection region 71*c* is made into a parallelogram that is 0.1 mm in width and 1.3 mm in length. The first capacitive coupling electrode 73*a* is formed so as to join two rectangles that are 0.175 mm in width and 0.6 mm in length, and each faces the first resonators 30*a*, 30*b* with a rectangle that is 0.1 mm in width. The second capacitive coupling electrode 73*b* is formed so as to join two rectangles that are 0.175 mm in width and 0.6 mm in length and each faces the first resonators 30*b*, 30*c* with a rectangle that is 0.1 mm in width.

The outlines of the first ground electrode 21, the second ground electrode 22, the first annular ground electrode 23, and the second annular ground electrode 24 are made into a rectangular that are 4 mm in width and 5 mm in length, the opening of the first annular ground electrode 23 is made into a rectangular that is 3.6 mm in width and 4.2 mm in length, and the opening of the second annular ground electrode 24 is made into a rectangular that is 3.55 mm in width and 4.2 mm in length. The entire shape of the bandpass filter is made into a rectangular parallelepiped that is 4 mm in width, 5 mm in length, and 0.51 mm in thickness. The space between the lower surface and the interlayer A of the laminated body 10 is made to be 0.165 mm, the space between the interlayer A and the first interlayer, the space between the first interlayer and the third interlayer, the space between the third interlayer and the interlayer B, the space between the interlayer B and the interlayer C, and the space between the interlayer C and the second interlayer are made to be 0.015 mm respectively, and the space between the second interlayer and the upper surface of the laminated body 10 is made to be 0.19 mm. The thickness of each electrode is made to be 0.01 mm, and the diameter of the input side connection conductor 43*a*, the output side connection conductor 43*b*, and the through-conductor 50 are made to be 0.1 mm. The relative permittivity of the dielectric layer 11 is made to be 7.5.

Figure 29:
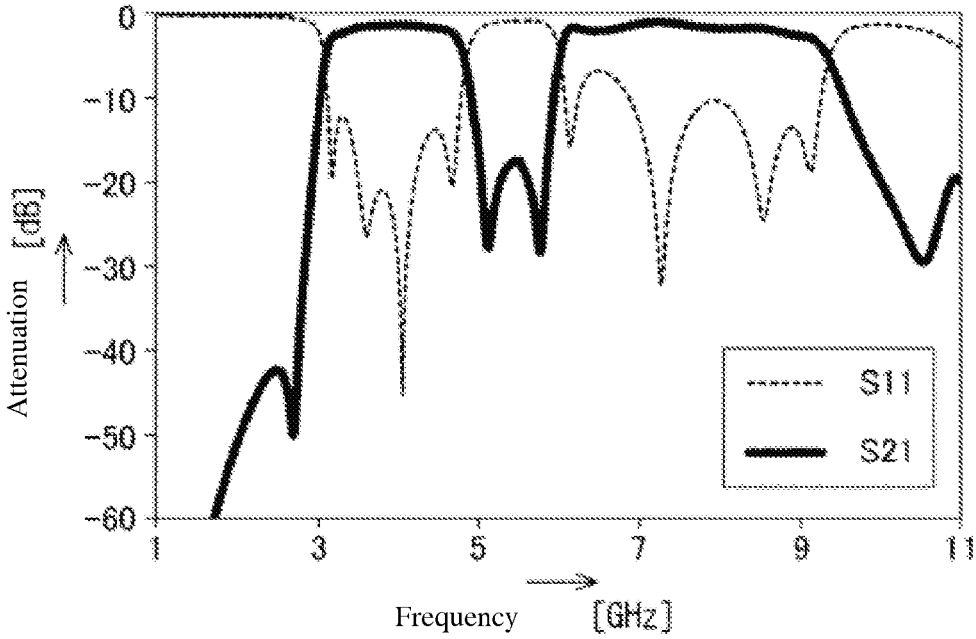
FIG. 29 is a diagram showing simulation results of electrical characteristics of the bandpass filter according to the Example 2.
Figure 30:
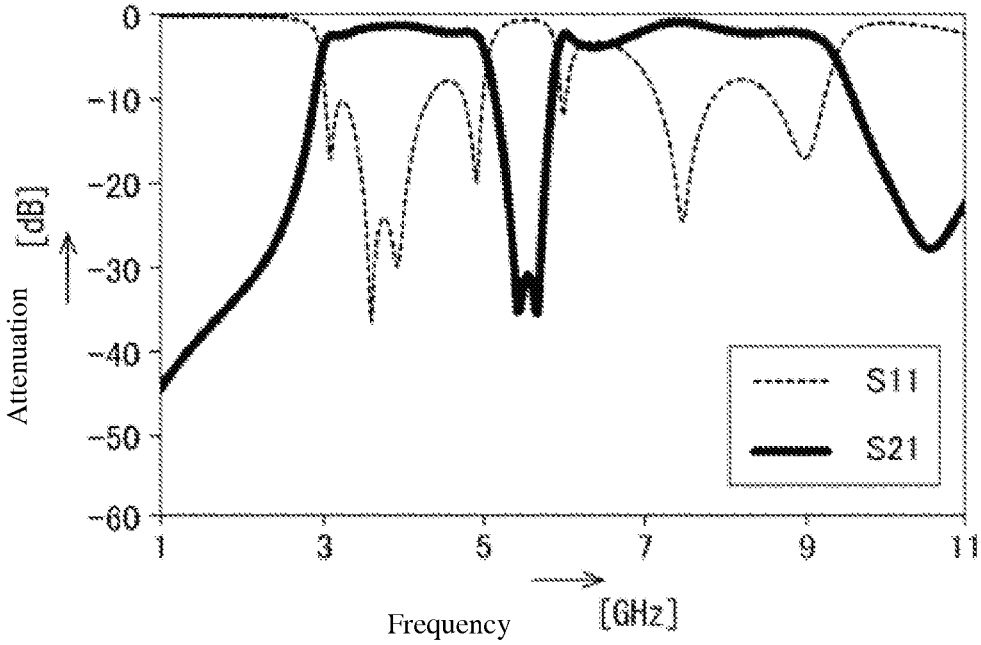
FIG. 30 is a diagram showing simulation results of electrical characteristics of the bandpass filter modified from the bandpass filter according to the Example 2.

FIG. 29 is a graph showing the simulation result, and FIG. 30 is a graph showing the simulation result of the electrical characteristics of the bandpass filter comprising the structure in which the single resonance electrode coupling conductor 71 is removed from the bandpass filter of the seventh embodiment shown in FIG. 25 and FIG. 26. In each of the graphs, the horizontal axis indicates frequency and the vertical axis indicates attenuation, showing the bandpass characteristics (S21) and reflectance characteristics (S11) of the bandpass filter. According to the graphs shown in FIG. 29 and FIG. 30, although the thickness of the laminated body 10 is very thin and 0.51 mm, excellent flat and low-loss bandpass characteristics, in which impedance is well matched, can be obtained across the two very wide passbands. Additionally, it is verified that, in the graph shown in FIG. 29, attenuation poles are formed in the vicinity of both sides of the low frequency side passband, and attenuation in the inhibition zone in the vicinity of the passband is significantly improved, as compared to the graph shown in FIG. 30. Based on this result, according to the bandpass filter of Example 2, even if it has a very thin shape, in each of 2 passbands, excellent bandpass characteristics that is flat and low-loss across the entire wide passband, and excellent bandpass characteristics, in which attenuation from the passband to the inhibition zone is increased rapidly, and in which attenuation in the vicinity of passband is sufficiently ensured, can be obtained, and thereby the effectiveness of the present invention was verified.

The present invention may be implemented in a variety of other forms without departing from the spirit and main characteristics thereof. Therefore, the abovementioned embodiments are merely exemplary in all aspects, and the scope of the present invention is not be limited in any way by the specification and should be defined only by the appended claims. Furthermore, all variations and modifications falling within the scope of the claims fall within the scope of the present invention.

DESCRIPTION OF THE SYMBOLS

10: Laminated body
11: Dielectric layer
21: First ground electrode
22: Second ground electrode
27: Base portion
28*a*,28*b*: Protruding portions
29*a*,29*b*: Complex resonance electrodes
30*a*,30*b*,30*c*,30*d*: Single resonance electrodes
40*a*: First input coupling electrode
40*b*: First output coupling electrode
41*a*: Second input coupling electrode
41*b*: Second output coupling electrode
43*a*: Input side connecting conductor
43*b*: Output side connecting conductor
45*a*: Electric signal input point
45*b*: Electric signal output point
71: Single resonance electrode coupling conductor
71*a*: Preceding-stage side coupling region
71*b*: Subsequent-stage side coupling region
71*c*: Connection region
72: Complex resonance electrode coupling conductor
72*a*: Second preceding-stage side coupling region
72*b*: Second subsequent-stage side coupling region
72*c*: Second connection region
80: Wireless communication module
81: Baseband portion
82: RF portion
84: Antenna
85: Wireless communication device

The invention claimed is:

1. A bandpass filter comprising:

a laminated body comprising a plurality of laminated dielectric layers;

a ground electrode disposed on a bottom surface of said laminated body;

a plurality of strip-shaped single resonance electrodes that are disposed side by side so as to be electromagnetically coupled to each other on a first interlayer of said laminated body, and each one end thereof is operable to be connected to a standard potential to function as a resonator that resonates at a first frequency;

a plurality of complex resonance electrodes each comprising a first end portion and a second end portion which is divided into divided portions arranged side by side, each divided portion having a strip shape, wherein each of the plurality of complex resonance electrodes is operable to be connected to a standard potential at its first end and resonate at a second frequency higher than said first frequency while said plurality of divided portions are operable to resonate at a third frequency higher than said second frequency, and said plurality of complex resonance electrodes are disposed side by side so as to be electromagnetically coupled to each other on a second interlayer different from said first interlayer of said laminated body;

a strip-shaped first input coupling electrode that is disposed on a third interlayer located between said first interlayer and said second interlayer of said laminated body, facing a first region over more than half a length, in a longitudinal direction, of a single resonance electrode on an input stage of said plurality of single resonance electrodes and electromagnetically coupled to the first region, and has an electrical signal input point into which electrical signals are input;

a strip-shaped first output coupling electrode that is disposed on said third interlayer of said laminated body, facing a second region over more than half a length, in a longitudinal direction, of a single resonance electrode on an output stage of said plurality of single resonance electrodes and electromagnetically coupled to the second region, and has an electrical signal output point from which said electrical signals are output;

a second input coupling electrode that is disposed on said third interlayer of said laminated body, and facing a divided portion on an input stage of said divided portions on a complex resonance electrode on an input stage of said plurality of complex resonance electrodes and electromagnetically coupled to the divided portion of the input stage; and a second output coupling electrode that is disposed on said third interlayer of said laminated body, and facing a divided portion on an output stage of said divided portions on a complex resonance electrode on an output stage of said plurality of complex resonance electrodes and electromagnetically coupled to the divided portion of the output stage;

wherein said plurality of single resonance electrodes and said divided portions on said plurality of complex resonance electrodes are disposed orthogonally to each other in a direction of lamination of said laminated body, said first input coupling electrode faces the single resonance electrode on the input stage of said plurality of single resonance electrodes in a first portion, said second input coupling electrode is connected to a side farther from said electrical signal input point relative to a center of said first portion of said first input coupling electrode in the longitudinal direction, and said electrical signals are input into the second input coupling electrode via said first input coupling electrode, and said first output coupling electrode faces the single resonance electrode on the output stage of said plurality of single resonance electrodes in a second portion, said second output coupling electrode is connected to a side farther from said electrical signal output point relative to a center of said second portion of said first output coupling electrode in the longitudinal direction, and said electrical signals are output from the second output coupling electrode via said first output coupling electrode.

2. The bandpass filter according to claim 1, wherein there are four or more of said single resonance electrodes, and said plurality of single resonance electrodes are disposed side by side so as to alternate the one end and the other end on said first interlayer of said laminated body, and further comprising:

a single resonance electrode coupling conductor that is disposed on a fourth interlayer of the laminated body located on an opposite side of said third interlayer from said first interlayer, where one end of said coupling conductor is operable to be connected to the standard potential in a vicinity of one end of the single resonance electrode on the input stage of said plurality of single resonance electrodes, the other end of said coupling conductor is operable to be connected to the standard potential in a vicinity of one end of the single resonance electrode on the output stage of said plurality of single resonance electrodes, and said coupling conductor has regions that are each electromagnetically coupled to and facing said one end of said single resonance electrode on the input stage and said single resonance electrode on the output stage.

3. The bandpass filter according to claim 2, wherein said single resonance electrode coupling conductor comprises a strip-shaped preceding-stage side coupling region that faces said single resonance electrode on the foremost stage in parallel; a strip-shaped subsequent-stage side coupling region that faces said single resonance electrode on the rearmost stage in parallel; and a connection region for connecting said preceding-stage side coupling region and said subsequent-stage side coupling region so that these regions are orthogonal to each other.

4. The bandpass filter according to claim 1, wherein said second input coupling electrode is disposed so as to intersect said single resonance electrode at said one end side relative to the center, in the longitudinal direction, of said single resonance electrode on the input stage in the direction of lamination of said laminated body, and said second output coupling electrode is disposed so as to intersect said single resonance electrode at said one end side relative to the center, in the longitudinal direction, of said single resonance electrode on the output stage in the direction of lamination of said laminated body.

5. The bandpass filter according to claim 1, wherein said second input coupling electrode is disposed on said third interlayer so as to be integrated with said first input coupling electrode, and said second output coupling electrode is disposed on said third interlayer so as to be integrated with said first output coupling electrode.

6. The bandpass filter according to claim 1, wherein said second input coupling electrode is disposed on a fifth interlayer between said second interlayer and said third interlayer so as to be connected to said first input coupling electrode via an input side connecting conductor, and said second output coupling electrode is disposed on the fifth interlayer so as to be connected to said first output coupling electrode via an output side connecting conductor.

7. A wireless communication module comprising:

an RF portion including the bandpass filter according to claim 1; and a baseband portion connected to said RF portion.

8. A wireless communication device comprising an RF portion including the bandpass filter according to claim 1, a baseband portion connected to said RF portion, and an antenna connected to said RF portion.

* * * * *